US010245600B2

(12) United States Patent
Singh

(10) Patent No.: US 10,245,600 B2
(45) Date of Patent: Apr. 2, 2019

(54) BLOWING NOZZLE

(71) Applicant: Nex Flow Air Products Corp., Richmond Hill (CA)

(72) Inventor: Amanjot Singh, Brampton (CA)

(73) Assignee: Nex Flow Air Products Corp., Richmond Hill, ON (CA)

( * ) Notice: Subject to any disclaimer, the term of this patent is extended or adjusted under 35 U.S.C. 154(b) by 0 days.

(21) Appl. No.: 15/565,005

(22) PCT Filed: Apr. 9, 2015

(86) PCT No.: PCT/CA2015/050291

§ 371 (c)(1),
(2) Date: Oct. 6, 2017

(87) PCT Pub. No.: WO2016/161498

PCT Pub. Date: Oct. 13, 2016

(65) Prior Publication Data

US 2018/0111134 A1 Apr. 26, 2018

(51) Int. Cl.

| | |
|---|---|
| ***B05B 1/00*** | (2006.01) |
| ***B05B 1/14*** | (2006.01) |
| ***B05B 1/18*** | (2006.01) |
| *B05B 1/26* | (2006.01) |

(52) U.S. Cl.

CPC ..... *B05B 1/185* (2013.01); *B05B 1/005* (2013.01); *B05B 1/14* (2013.01); *B05B 1/262* (2013.01)

(58) Field of Classification Search

CPC .. B05B 1/005; B05B 1/02; B05B 1/14; B05B 1/185; Y10S 239/07; B08B 5/00; B08B 5/02; B08B 2205/005

USPC ..... 239/291, DIG. 7

See application file for complete search history.

(56) References Cited

U.S. PATENT DOCUMENTS

| | | | | |
|---|---|---|---|---|
| 2,307,312 A | | 1/1943 | Whiting | |
| 3,318,534 A | * | 5/1967 | Stolteben | B05B 1/005 239/291 |
| 4,050,632 A | * | 9/1977 | Wyse | B05B 1/005 239/425 |

(Continued)

FOREIGN PATENT DOCUMENTS

| | | |
|---|---|---|
| CA | 37820 | 5/1974 |
| CA | 1032577 A | 6/1978 |

(Continued)

OTHER PUBLICATIONS

Exair.com. "Atto Super Air Nozzle" [online], [retrieved Oct. 27, 2014], Retrieved from http://www.exair.com/en-US/Primary%20Navigation/Products/Air%20Nozzles/Air%20N, no pagination.

(Continued)

*Primary Examiner* — Darren W Gorman

(57) ABSTRACT

A blowing nozzle having a substantially parabolic blowing end is provided which entrains ambient gases into the output flow. A plurality of outlets are arranged so as reduce turbulence within the flow. The substantially parabolic blowing end converges at an apex coaxial with a blowing axis. A central outlet is provided at the apex to generate a core stream of gas. First outlets surround the central outlet. Second outlets surround the first outlets and are angled inward toward the blowing axis. Fins and/or additional outlets may be provided.

20 Claims, 42 Drawing Sheets

(56) References Cited

U.S. PATENT DOCUMENTS

| | | | | |
|---|---|---|---|---|
| D269,519 | S | 6/1983 | Braun | |
| D269,520 | S | 6/1983 | Braun | |
| D269,521 | S | 6/1983 | Braun | |
| 5,056,718 | A * | 10/1991 | Wakefield | B05B 1/10 239/441 |
| 5,402,938 | A | 4/1995 | Sweeney | |
| 5,964,405 | A | 10/1999 | Benary et al. | |
| 6,311,902 | B1 * | 11/2001 | Mueller | B05B 1/005 239/548 |
| 6,415,991 | B1 * | 7/2002 | Eriksson | B05B 1/005 239/290 |
| D520,538 | S | 5/2006 | de Leeuw et al. | |
| 7,588,199 | B2 | 9/2009 | Huffman | |
| D607,026 | S | 12/2009 | Risse | |
| 8,672,241 | B2 | 3/2014 | Wurz | |
| 8,827,181 | B2 | 9/2014 | Nolte et al. | |
| 2005/0284957 | A1 | 12/2005 | Haruch | |
| 2006/0027679 | A1 * | 2/2006 | Gratteau | F02K 1/40 239/291 |
| 2008/0073445 | A1 | 3/2008 | Yu et al. | |
| 2009/0223227 | A1 | 9/2009 | Lipinski et al. | |
| 2012/0248223 | A1 * | 10/2012 | Masson | B05B 1/005 239/525 |
| 2014/0048622 | A1 | 2/2014 | Haruch | |

FOREIGN PATENT DOCUMENTS

| | | | |
|---|---|---|---|
| CA | 54613 | | 6/1985 |
| CA | 55692 | | 1/1986 |
| CA | 89064 | | 3/2000 |
| CA | 110748 | A | 8/2006 |
| CA | 149802 | | 1/2014 |
| CN | 201070603 | Y | 6/2008 |
| CN | 104069960 | A | 10/2014 |
| CN | 104069961 | A | 10/2014 |
| WO | WO8101669 | A1 | 6/1981 |

OTHER PUBLICATIONS

Exair.com. "Large Super Air Nozzles," [online], [retrieved on Oct. 27, 2014] Retrieved from http://www.exair.com/en-US/Primary%20Navigation/Products/Air%20Nozzles/Air%20N, no pagination.

Exair.com. "Mini Super Air Nozzles," [online], [retrieved Oct. 27, 2014] Retrieved from http://www.exair.com/en-US/Primary%20Navigation/Products/Air%20Nozzles/Air%20N, no pagination.

Exair.com. "Super Air Nozzles," [online], [retrieved Oct. 27, 2014] Retrieved from http://www.exair.com/en-US/Primary%20Navigation/Products/Air%20Nozzles/Air%20N, no pagination.

International Preliminary Report on Patentablity Chapter II issued in PCT/CA2015/050291, dated Jul. 12, 2017, 22 pages.

International Search Report and Written Opinion issued in PCT/CA2015/050291, dated Dec. 14, 2015, 8 pages.

Silvent. "Silvent 1011," [online], [retrieved Oct. 27, 2014] Retrieved from https://www.silvent.com/us/products/? search=&group=1702&product=2289, no pagination.

Silvent. "Silvent 2005," [online], [retrieved Oct. 27, 2014] Retrieved from https://www.silvent.com/us/products/?search=&group=1702&product=2310, no pagination.

Silvent. "Silvent 209," [online], [retrieved Oct. 27, 2014] Retrieved from http://www.exair.com/en-US/Primary%20Navigation/Products/Air%20Nozzles/Air%20N, no pagination.

* cited by examiner

BLOWING NOZZLE

TECHNICAL FIELD

The present invention relates to the field of nozzles. More specifically, the present invention relates to a blowing nozzle for pressurized gases.

BACKGROUND

Blowing nozzles are used in a large number of applications in various industries. For example, compressed air and other gases emitted from blowing nozzles are typically used for cooling, cleaning, drying, liquid blowoff, material conveying, ejecting, and sorting tasks.

Although it is sometimes possible to use an open pipe to emit the compressed gases, it is usually advantageous to use a nozzle to reduce noise, energy consumption, and to increase worker safety. A variety of blowing nozzles are known in the art.

In many applications, the blowing nozzle must provide a certain minimum force to fulfill its function. For example, in a cooling, cleaning, or drying application, the blowing nozzle must exert enough force to reach its intended target. In a liquid blowoff, material conveying, ejecting, or sorting task, the flow generated by the nozzle must have enough force to move the material in question. For many nozzles, force can be increased by supplying compressed gases at increased pressures.

A frequent problem with blowing nozzles is gas consumption. The compression of air or other gases to supply the blowing nozzle requires energy and so a reduction of gas consumption often translates to energy savings, which in turn lowers operating costs. However, reductions in gas consumption are often accompanied by lower forces produced by the nozzle.

"Air amplifying" nozzles address gas consumption by entraining ambient air into the flow generated by the nozzle using the Coanda effect. This amplifies the flow produced by the nozzle. In some cases, the flow rate can be amplified by up to 25-fold by this effect. However, there is a persistent need to provide increased efficiencies with respect to the amount of ambient gases that can be entrained into the output flow of the nozzle.

SUMMARY OF THE INVENTION

It is an object of the invention to provide a blowing nozzle which efficiently entrains ambient gases into the output flow so as to reduce the volume of compressed gases consumed in its operation.

It is a further object of the present invention to provide a nozzle which generates a greater amount of force for a given amount of supply pressure.

The present invention provides a nozzle for blowing pressurized gas. The nozzle has an elongate nozzle body with a supply end for receiving a supply of compressed gas and a substantially parabolic blowing end for blowing compressed gas along a blowing axis. The blowing end converges at an apex coaxial with the blowing axis. The blowing end comprises a central outlet for generating a core stream of gas at the apex.

The blowing end further comprises at least three first outlets disposed at a first radius from the blowing axis. The first outlets are substantially parallel to the blowing axis and surround the core stream of gas. In some embodiments, the diameter of the first outlets is less than the diameter of the central outlet. In some embodiments, the total discharge area of the first outlets is greater than the discharge area of the central outlet.

The blowing end further comprises at least three second outlets disposed at a second radius from the blowing axis. The second radius is greater than the first radius. The diameter of the second outlets is less than the diameter of the first outlets. In some embodiments, the total discharge area of the second outlets is less than the total discharge are of the first outlets. In further embodiments, the second outlets are offset relative to the first outlets.

The second outlets are angled inward toward the blowing axis, preferably at an angle between 0.25 and 5 degrees. In some embodiments, the angle is about 0.5 degrees, about 1 degree, about 1.5 degrees, or about 2 degrees. The slight inward angling of the holes encourages a more laminar flow pattern at the first and central outlets, which in turn prevents turbulence that otherwise reduces the force applied by the nozzle.

As a result of this arrangement, the first outlets draw gases from the second outlets, which in turn draw ambient gases along the substantially parabolic surface of the nozzle. The central outlet may in turn draw air from the first outlets into the blowing axis.

In some embodiments, the nozzle further comprises at least six fins parallel to the blowing axis and extending outwardly from the elongate nozzle body and along the blowing end thereof. These fins are believed to provide additional surfaces upon which to entrain ambient gases via the Coanda effect. In some embodiments, each of the second outlets is positioned between a pair of the at least six fins to improve the rate at which ambient gases are entrained into the flow by the second outlets.

The invention may also comprise additional rings of outlets between the first and second outlets or beyond the second outlet, positioned at various radial distances from the blowing axis and longitudinal distances from the apex. These rings are believed to provide additional amplification to the flow of the nozzle in a step-like manner, moving from the periphery of the nozzle toward the central blowing axis. Variations in relative outlet size and position are believed to enhance this effect.

In one embodiment, the nozzle comprises at least three third outlets disposed at a third radius from the blowing axis. The third radius is greater than the first radius but less than the second radius. The diameter of the third outlets is greater than the diameter of the first outlets. In some embodiments, the total discharge area of the third outlets is greater than the total discharge are of the first outlets. In further embodiments, the third outlets are offset relative to the first outlets.

In some embodiments, the nozzle comprises at least three further outlets disposed on the first radius and offset from the first outlets. The diameter of the further outlets is greater than the diameter of the first outlets and third outlets but less than the diameter of the central outlet. In some embodiments, the total discharge area of the further outlets is greater than the total discharge are of the first outlets.

In further embodiments, the nozzle comprises at least three fourth outlets at a fourth radius from the blowing axis. The fourth radius is greater than the second radius. The diameter of the fourth outlets is greater than the diameter of the second outlets. In some embodiments, the total discharge area of the fourth outlets is greater than the total discharge are of the second outlets. In further embodiments, the third outlets are offset relative to the second outlets.

In some embodiments, the second outlets are positioned at a second distance from the apex, in which the second distance is greater than the first distance. In further embodiments, the third outlets are positioned at a third distance from the apex, in which the third distance is less than the second distance and greater than the first distance. In yet further embodiments, the fourth outlets are positioned at a fourth distance from the apex, in which the fourth distance is greater than the first distance.

In some embodiments, the blowing end is comprised of a plurality of conical frustrum segments having increasing opening angles toward the apex. In other embodiments, the blowing end is a paraboloid.

In another broad aspect, the invention consists of a method of generating a flow of compressed gases along a blowing axis from a nozzle having a substantially parabolic blowing end converging at an apex coaxial with the blowing axis. The method comprises the steps of: (a) supplying compressed gas to an inlet of the nozzle, (b) emitting a core stream of gas from a central outlet at the apex of the blowing end of the nozzle, (c) emitting a first concentric stream of gas from the blowing end which surrounds the core stream, the first stream having a higher pressure than the core stream, and (d) emitting a second concentric stream of gas from the blowing end which surrounds the first stream, the second stream angled inward toward the blowing axis and having a higher pressure than the first stream.

In another embodiment, the invention consists of a method further comprising emitting a third concentric stream of gas which surrounds the first stream and is surrounded by the second stream, the third stream having a lower pressure than the first stream and the second stream.

In yet another embodiment, the invention consists of a method further comprising emitting a fourth stream of gas which surrounds the second stream, the fourth stream having a lower pressure than the second stream.

In yet still another embodiment, the invention consists of a method wherein the nozzle further comprises at least six fins substantially parallel to the blowing axis and extending outwardly from the elongate nozzle body proximate to the second or fourth streams.

DETAILED DESCRIPTION

With reference to the above drawings, various examples will now be disclosed which illustrate, by way of example only, various embodiments of the invention contemplated herein.

Figure 1:
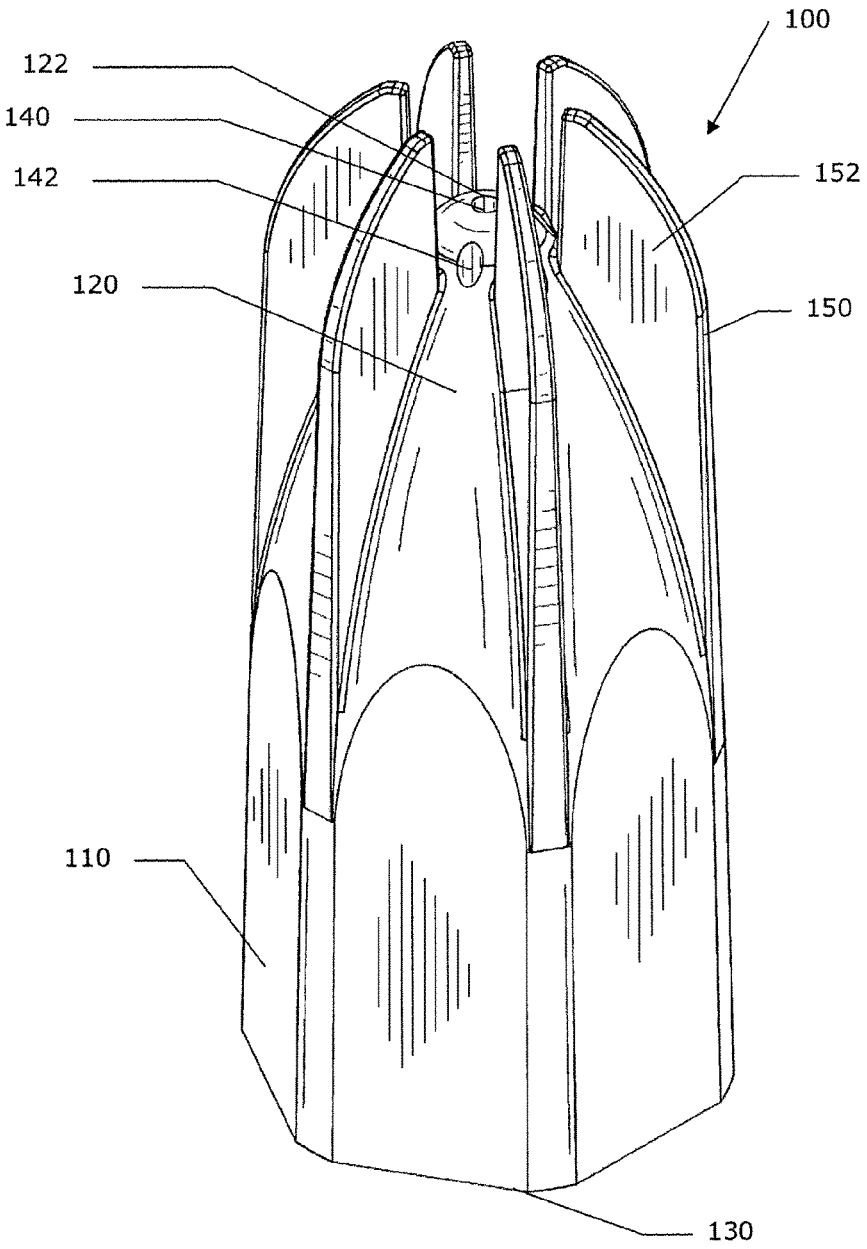
FIGS. 1 and 2 provide top and bottom perspective views, respectively, of a nozzle according to one embodiment of the present invention.

FIG. 1 provides a nozzle 100 in accordance with a first embodiment of the present invention. In general terms, the nozzle 100 consists of an elongate nozzle body 110 having a blowing end 120 and a supply end 130. A series of outlets 140, 142, 146 are provided on the blowing end 120 for generating a flow of compressed gas along a blowing axis 112 (See FIG. 5). An inlet 132 is provided on the supply end 130 for supplying compressed gases to the nozzle 100.

Figure 2:
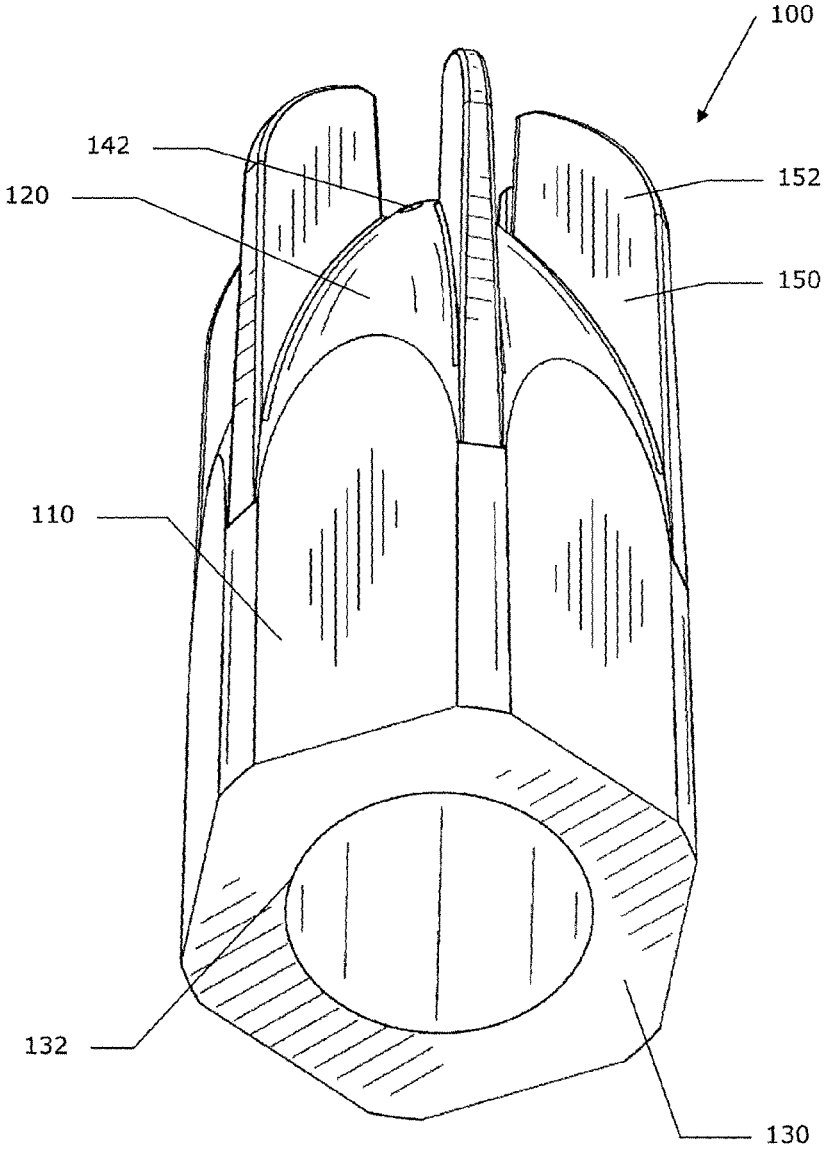

The supply end 130 and its inlet 132 can be seen in FIG. 2. The inlet 132 may be connected to a source of compressed gas by various suitable means known in the art, such as NPT fittings, BSP fittings, threaded pipes, fasteners, welding, solvent welding, soldering, brazing, compression fittings, flare fittings, flange fittings, mechanical fittings, grooved pipe fittings, and crimped or pressed fittings, as appropriate for the particular application. In this embodiment, the inlet is a 0.25" NPT connector. Various compressed gases may be supplied to the inlet 132, including compressed air and inert gases such as nitrogen. A variety of gas supply pressures may be used, although gas supply pressures of less than 250 psi are preferred.

The blowing end 120 is substantially parabolic and converges on an apex 122 positioned on the blowing axis 112. In the embodiment shown in FIG. 1, the blowing end 120 is a paraboloid (i.e. a three dimensional shape resulting from the rotation of a parabola along a central axis). In other embodiments, the blowing end 120 may have a less perfect (but still substantially parabolic) shape, such as a series of conical frustrums that progressively converge on the apex 122 (see for e.g. FIG. 13).

The blowing end 120 thus provides a surface upon which ambient gases, such as ambient room air, can be entrained from the periphery of the nozzle 100 toward the apex 122 via the Coanda effect. It is believed that the parabolic (or substantially parabolic) shape of the blowing end 120 may increase the efficiency with which ambient gases are entrained by the nozzle 100, thereby amplifying the air flow along the blowing axis 112.

Figure 5:
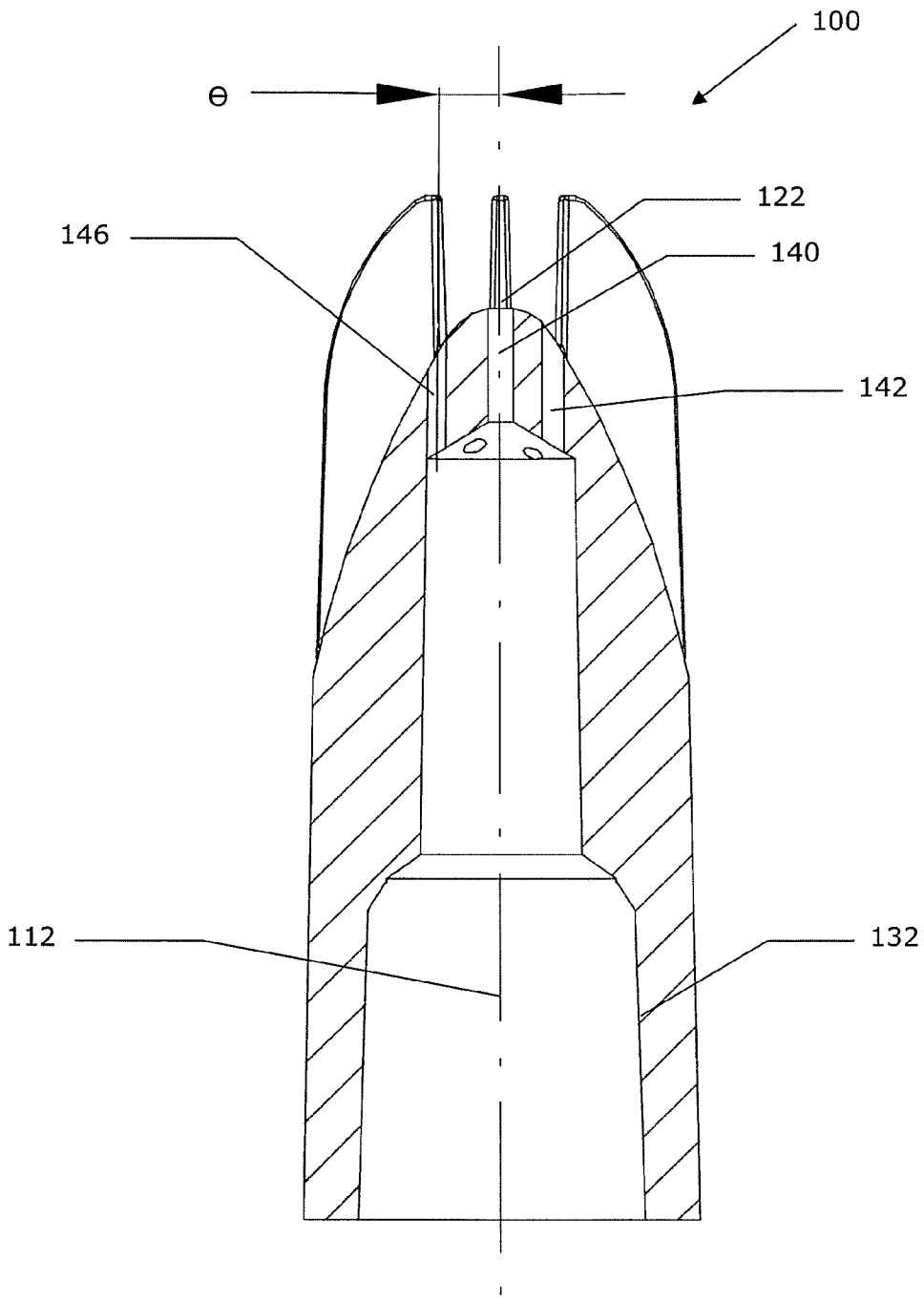
Figure 7:
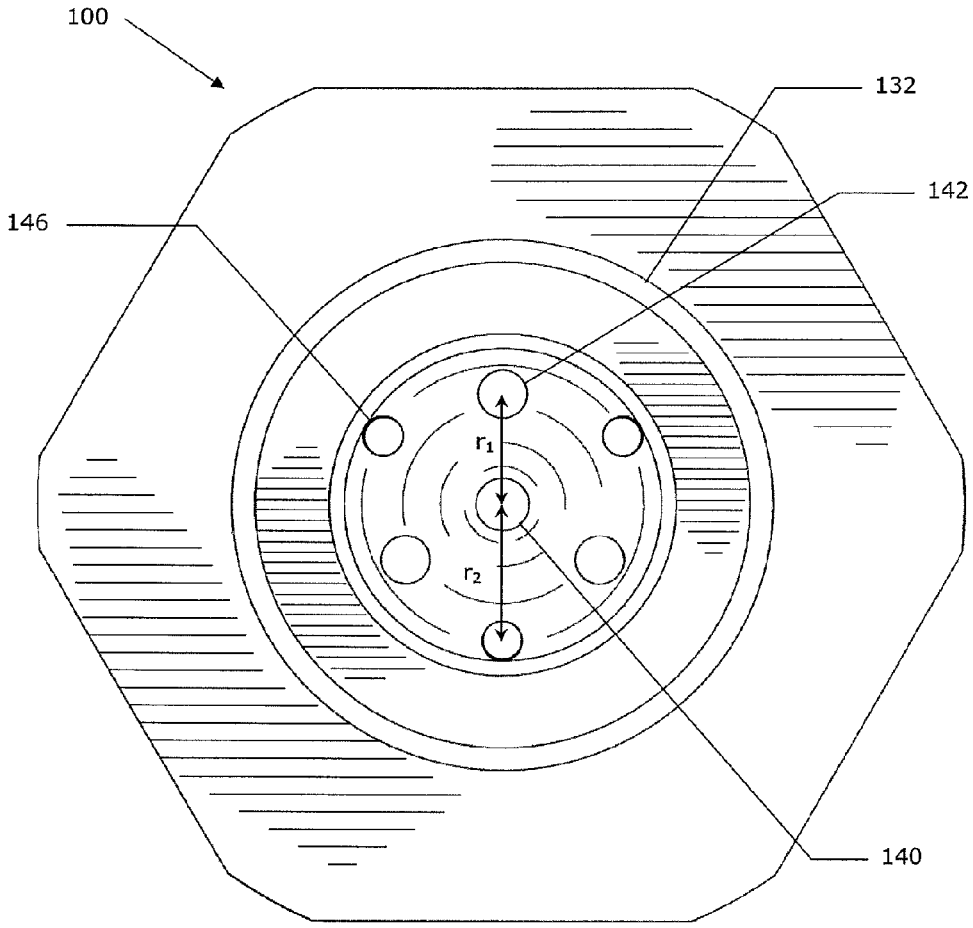
Figure 8:
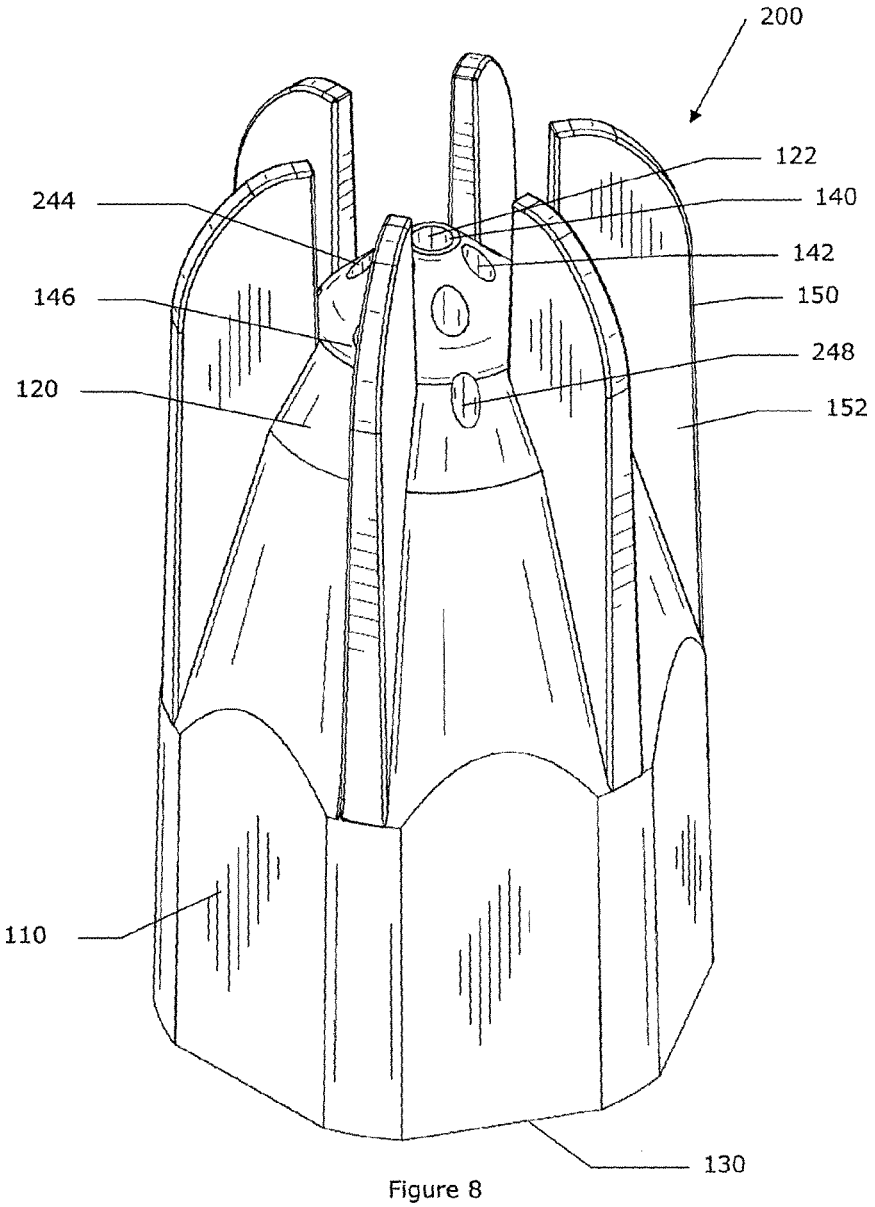
FIGS. 8-9 provide top and bottom perspective views, respectively, of a nozzle according to a second embodiment of the present invention.
Figure 9:
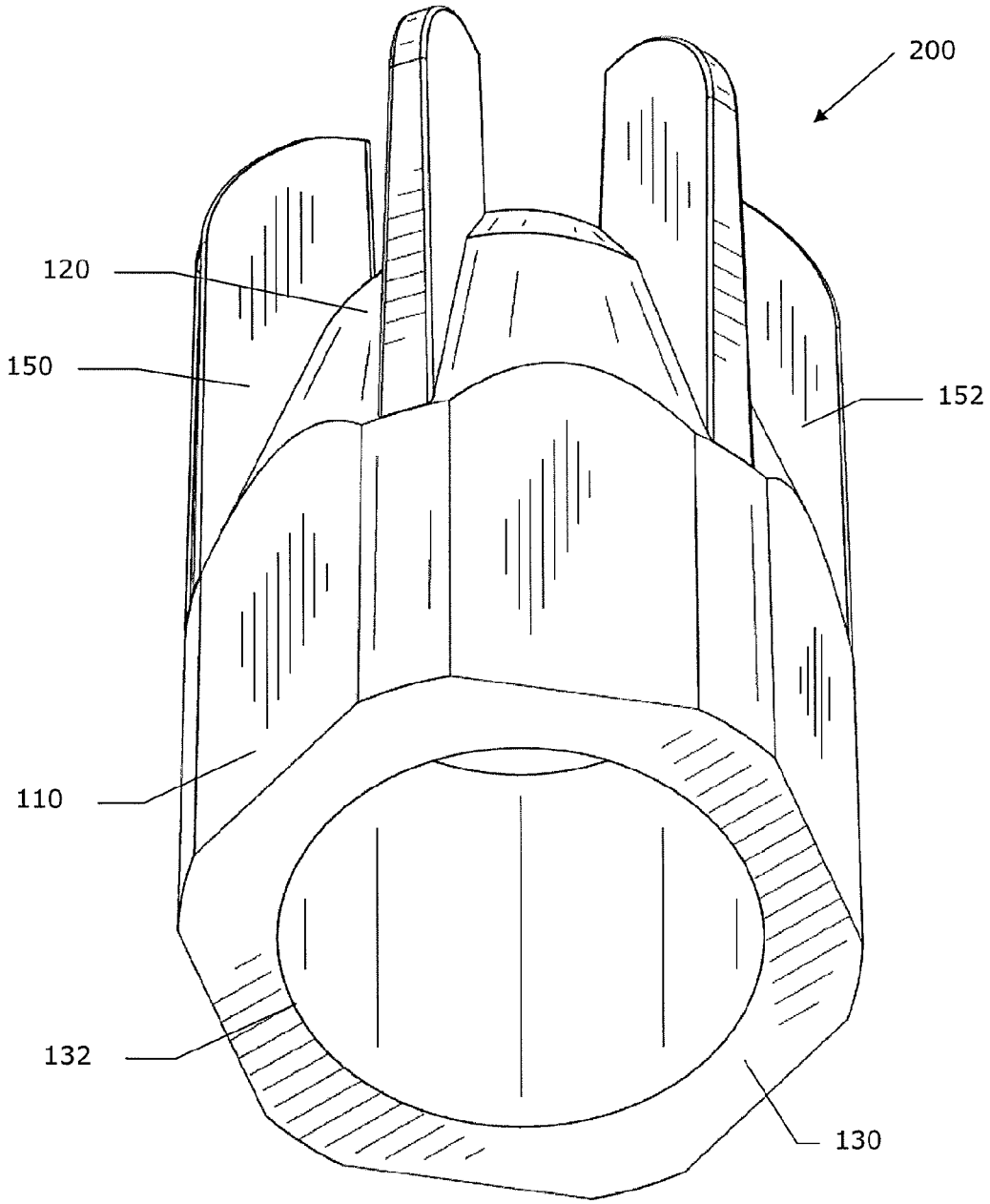
Figure 10:
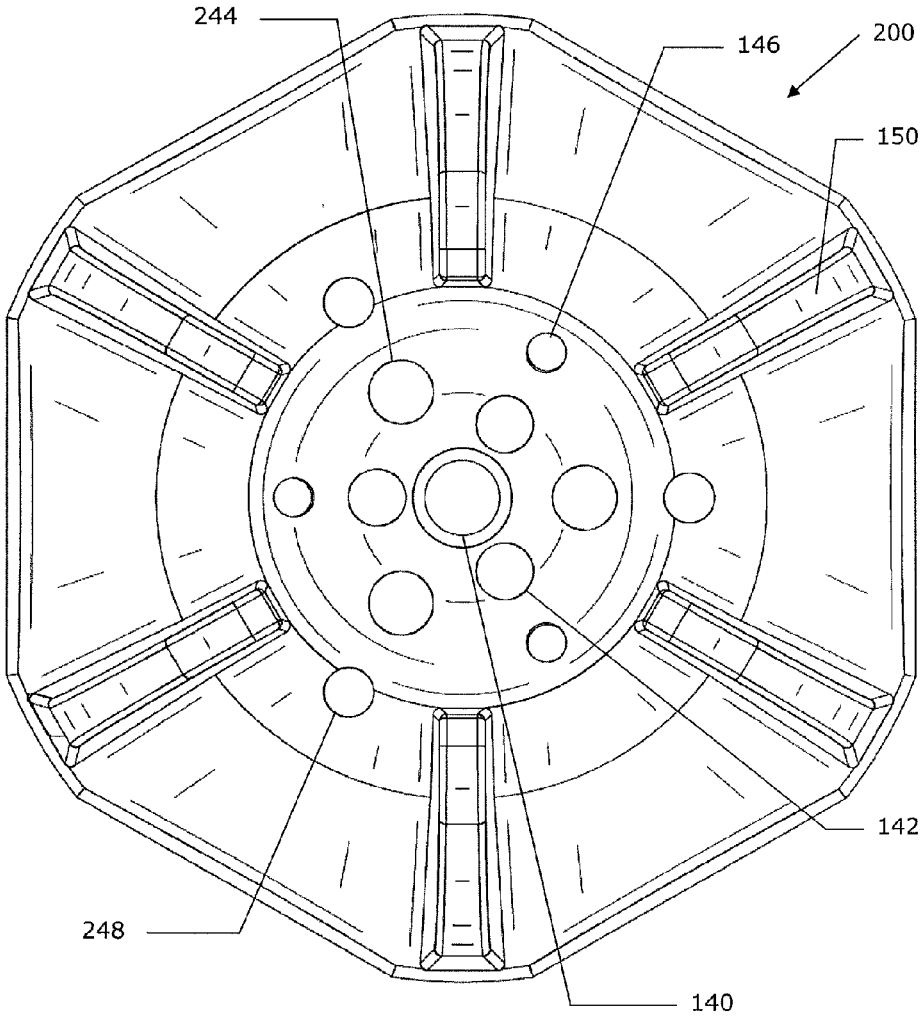
FIGS. 10-14 provide a top (FIG. 10), side (FIG. 11), cross-sectional (FIG. 12), rotated side (FIG. 13), and bottom (FIG. 14) view of the nozzle depicted in FIGS. 8-9.
Figure 11:
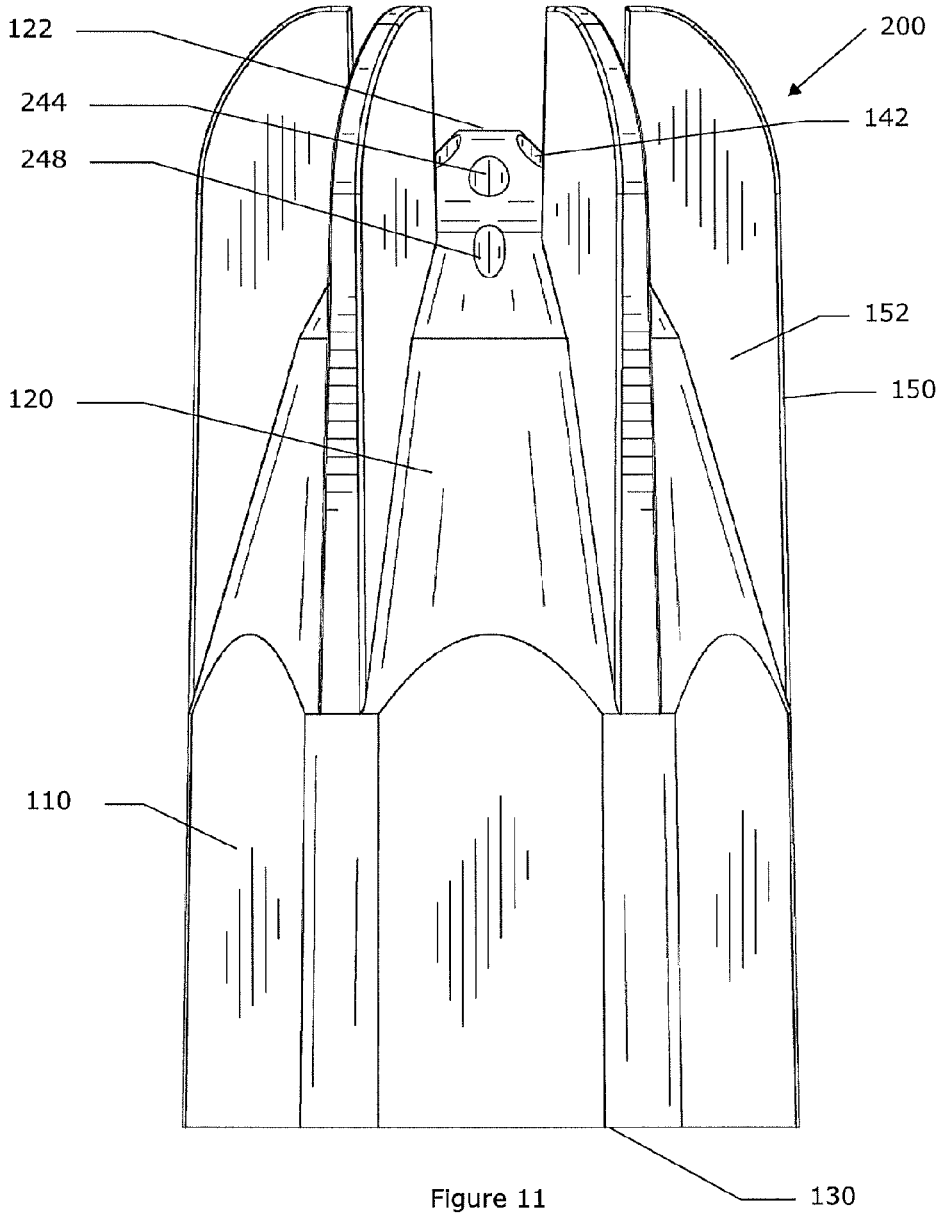
Figure 12:
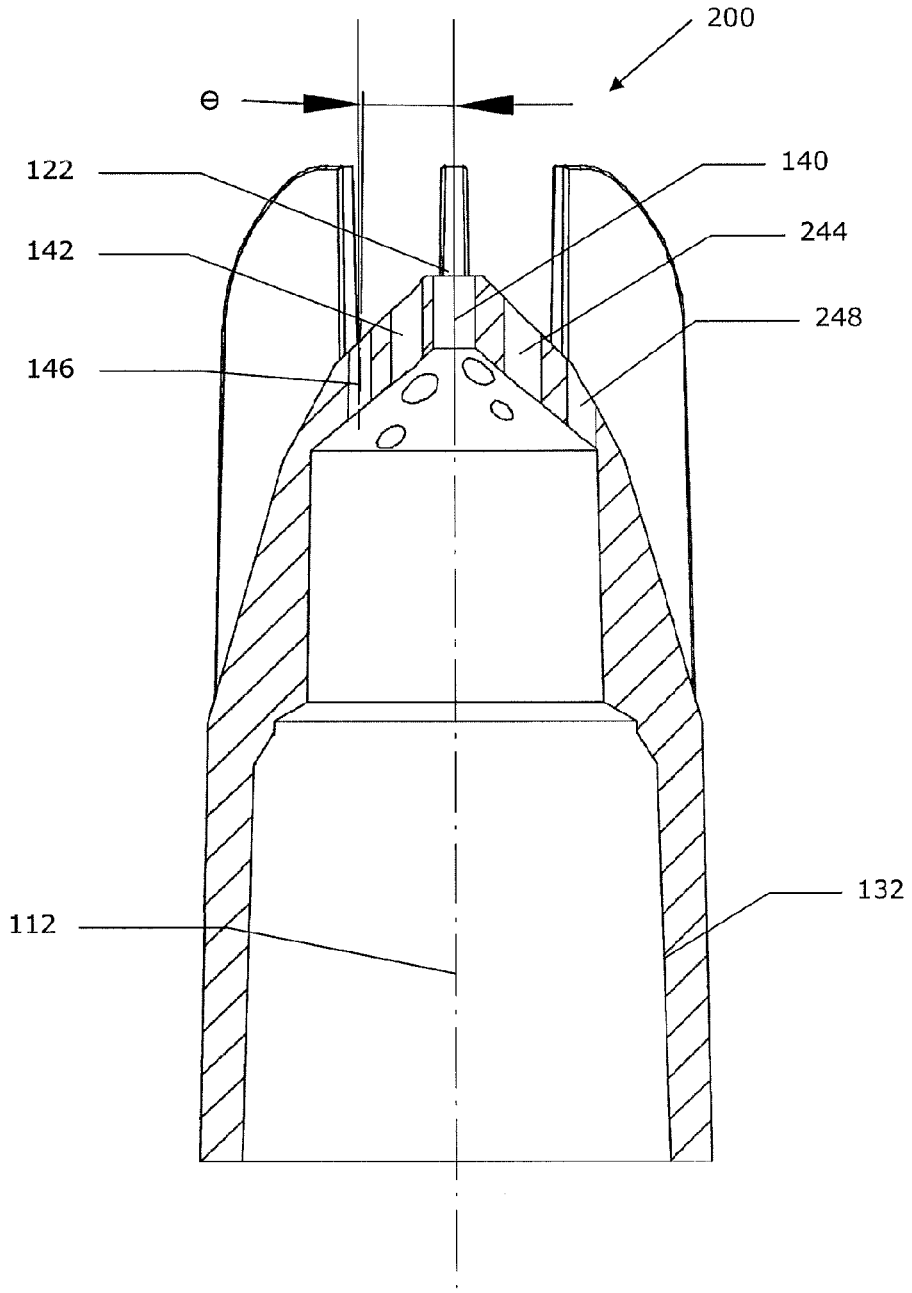

As can be seen in FIGS. 5 and 7, a central outlet 140 is provided at the apex 122 of the blowing end 120. In operation, the central outlet 140 generates a core stream of gas along the blowing axis 112.

Figure 6:
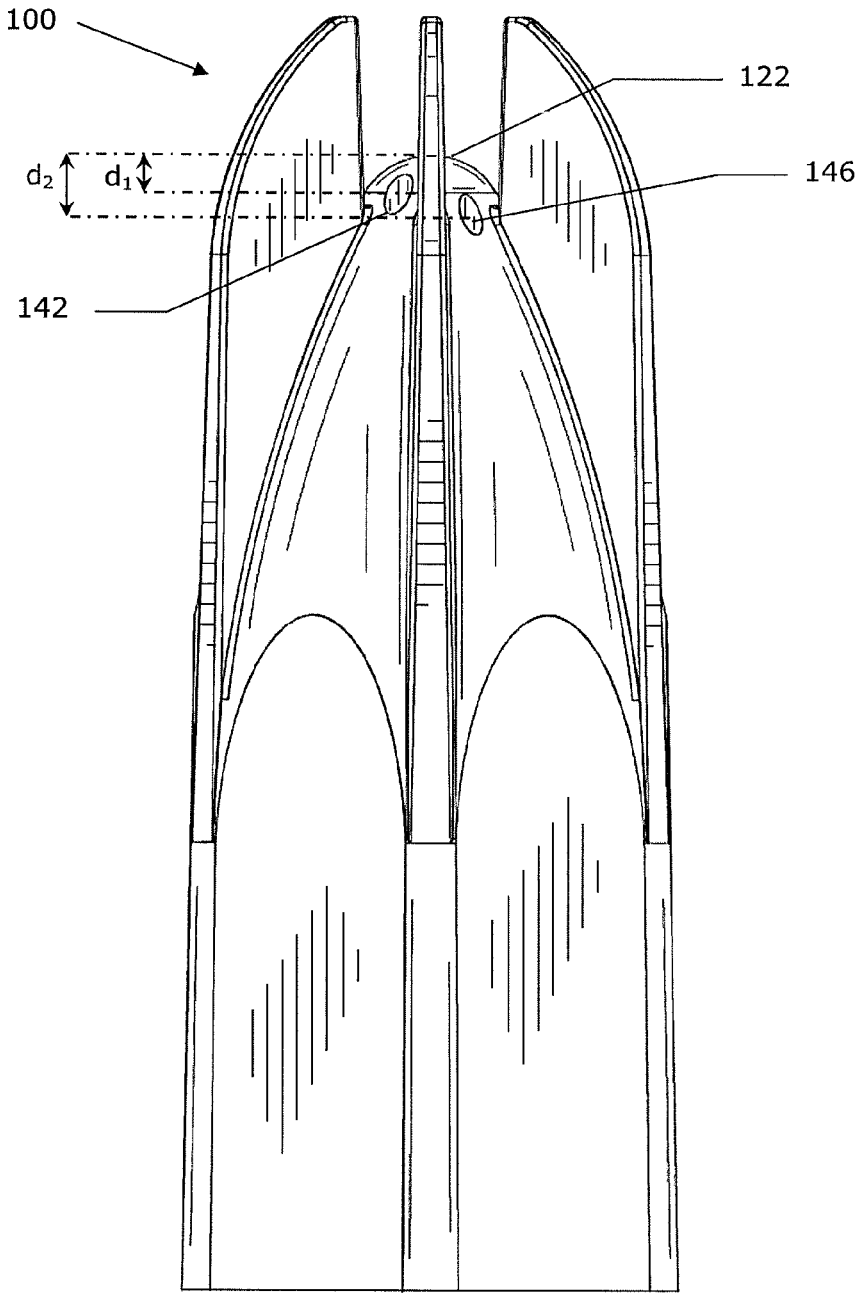

As can be seen in FIG. 7, at least three first outlets 142 are disposed along a first radius ($r_1$) from the blowing axis 112. As can be seen in FIG. 6, this places the first outlets 142 at a first distance ($d_1$) from the apex 122. The nozzle 100 shown in FIG. 1 has three first outlets 142. In other embodiments, the number of first outlets 142 can be increased beyond three, particularly where the overall diameter of the nozzle body 110 increases.

Figure 3:
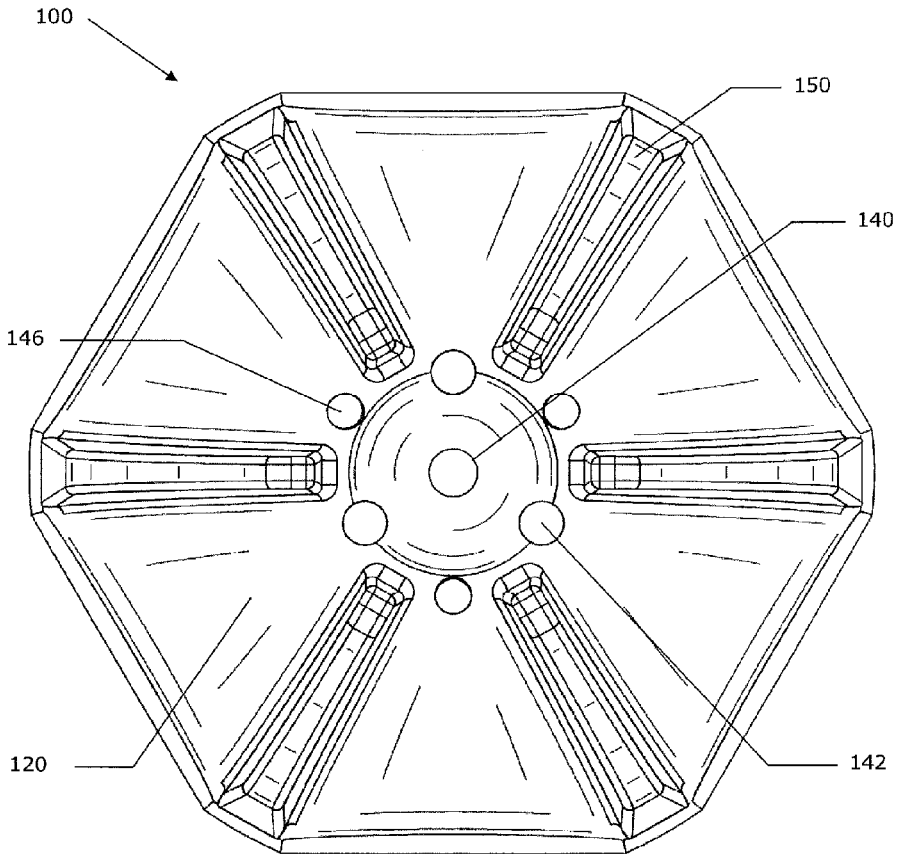
FIGS. 3-7 provide a top (FIG. 3), side (FIG. 4), cross-sectional (FIG. 5), rotated side (FIG. 6), and bottom (FIG. 7) view of the nozzle depicted in FIGS. 1-2.
Figure 4:
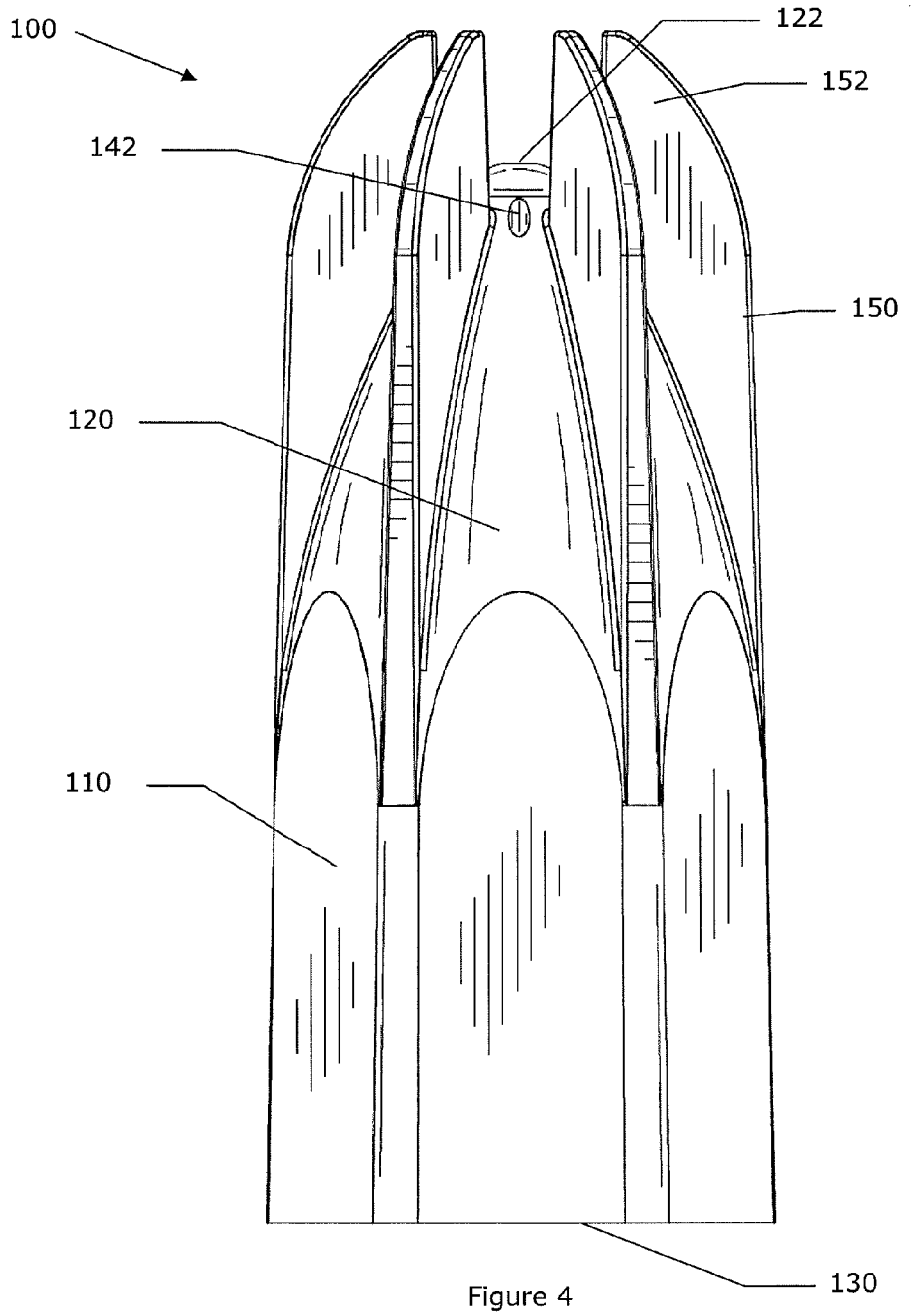

As can be best seen in FIG. 3, each of the first outlets 142 in the nozzle 100 of FIGS. 1-7 has a diameter which is less than the diameter of the central outlet 140. In this embodiment, the diameter of the first outlets is approximately 12 percent smaller than the diameter of the central outlet 140. Nevertheless, as there are three first outlets 142, the total discharge area of the plurality of first outlets 142 is still greater than the central outlet 140.

The first outlets 142 are substantially parallel to the blowing axis 112. The output from the first outlets 142 surrounds the core stream of gas generated by the central outlet 140. It is believed that this effectively increases the diameter and volume of the core stream of gas generated by the central outlet 140. This arrangement may also provide for a more laminar output flow as compared to merely increasing the discharge area of a singular central outlet 140 by an equivalent amount.

At least three second outlets 146 are also disposed at a second radius ($r_2$) from the blowing axis 112 (See FIG. 7). The second radius ($r_2$) is larger than the first radius ($r_1$). In this embodiment, the second radius ($r_2$) is approximately 24 percent greater than the first radius ($r_1$). As can be seen in FIG. 6, the second outlets 146 in this embodiment are positioned at a second distance ($d_2$) from the apex 122. The second distance ($d_2$) is greater than the first distance ($d_1$).

The diameter of the second outlets 146 is also less than the diameter of the first outlets 142. In this embodiment, the diameter of the second outlets 146 is approximately 15 percent smaller than the first outlets 142. In the embodiment shown in FIG. 1, the total discharge area of the second outlets 146 is less than the total discharge area of the first outlets 142.

As best illustrated in FIG. 5, the second outlets 146 are angled inward toward the blowing axis 112. In this embodiment, the angle (θ) is about 0.5 degrees. In other embodiments the angle may range between 0.25 and 5 degrees, depending on the application. Specific angles (θ) include about 0.5 degrees, about 1.0 degrees, about 1.5 degrees, or about 2 degrees.

The configuration of the second outlets 146 helps to focus the output of the first and central outlets 142, 140. For example, the reduced diameter of the second outlets 146 increases the relative pressure of the output from the second outlets 146 and the inward angling of the second outlets 146 is believed to resist the tendency of the compressed gases escaping the first and central outlets 142, 140 to expand outward in a conical fashion. In some applications, this may result in a more laminar flow from the nozzle 100, which in turn may increase the amount of force exerted by the nozzle 100 for a given gas supply pressure. It is also believed that the inward angling of the second outlets 146 may help entrain ambient gases into the core stream of gas generated by the central and/or first outlets 140, 142, thereby reducing consumption of compressed gas by the nozzle 100.

Without committing to a particular theory, it is also believed that a progressive reduction in outlet diameter from the central outlet 140 to the first outlets 142 to the second outlets 146 may enhance the rate at which ambient gases are entrained into the flow of the nozzle 100. More specifically, a lower pressure/higher volume flow at the center of the nozzle may help convey ambient gases from the periphery of the nozzle into the core stream of gas at the blowing axis 112.

In the embodiment shown in FIG. 1, the first and second outlets 142, 146 exhibit substantial radial symmetry and are offset relative to one another. The resulting sequential offset arrangement allows the air flow generated by the second outlets 146 to interact with the spaces between the first outlets 142 above. Without committing to any particular theory, it is believed that offsetting successive rings of outlets may assist in entraining ambient gases into the core stream of gas generated by the central and/or first outlets 140, 142, thereby reducing consumption of compressed gas.

In some embodiments, the nozzle may also include fins 150. In the embodiment shown in FIG. 1, the nozzle 100 is provided with six fins 150. When present, the fins are substantially parallel to the blowing axis 112 and extend outwardly from the nozzle body 110 and along the surface of the blowing end 120. The fins are believed to provide additional surfaces 152 upon which ambient gases may travel via the Coanda effect, which may increase the amount of ambient gases entrained into the output flow of the nozzle 100. In some embodiments, the second outlets 146 are positioned between the fins 150, which may increase the rate at which ambient gases are entrained.

In some embodiments, such as the embodiment shown in FIG. 1, the fins 150 may extend beyond the apex 122, particularly where it is desirable to prevent people or objects from coming in contact with, or potentially obstructing, the outlets 140, 142, 146 of the nozzle 100.

In operation, the inlet 132 of a nozzle according to the present invention is connected to a supply of compressed gas. The compressed gas is then ejected from the outlets to form a stream of gas. Ambient gases, such as room air, are entrained into the flow of the nozzle, which increases the volume of the flow emitted from the nozzle. In some applications, the arrangement and angling of the outlets may also provide for more laminar flow, thereby greater forces at a given distance and supply pressure.

A number of variations can be made on the nozzle 100 described above.

FIGS. 8-14 depict a nozzle 200 according to a second embodiment of the present invention. In general terms, the nozzle 200 consists of an elongate nozzle body 110 having a blowing end 120 and a supply end 130. The blowing end 120 of the nozzle 200 is substantially parabolic. A series of outlets 140, 142, 244, 146, 248 are provided (See FIG. 10) on the blowing end 120 for generating a flow of compressed gas along a blowing axis 112 (See FIG. 12). An inlet 132 is provided on the supply end 130 for supplying compressed gases to the nozzle 100. In this embodiment, the inlet 132 is a 0.5" NPT connector.

Like the nozzle 100 in FIGS. 1-7, the nozzle 200 in FIGS. 8-14 has a central outlet 140 at an apex 122, first outlets 142 disposed about the central outlets at a first distance ($d_1$) and first radius ($r_1$), and second outlets 146 positioned below the first outlets at a second distance ($d_2$) and a second radius ($r_2$). Each of these features are analogous to those described for nozzle 100 above.

In this embodiment, the first outlets 142 have a diameter which is approximately 24 percent smaller than the central outlet 140 and the diameter of the second outlets 146 is approximately 31 percent smaller than the first outlets 142. Likewise, the second radius ($r_2$) is approximately twice the size of the first radius ($r_1$). The second outlets 146 are angled inward at an angle (θ) of 1.0 degrees. Fins 150 are also present on this embodiment, the surfaces 152 of which extend beyond the apex 122 of the nozzle 200.

Unlike the nozzle 100 in FIGS. 1-7, the nozzle 200 in FIGS. 8-14 has two additional sets of outlets, referred to here as third and fourth outlets 244, 248.

Figure 13:
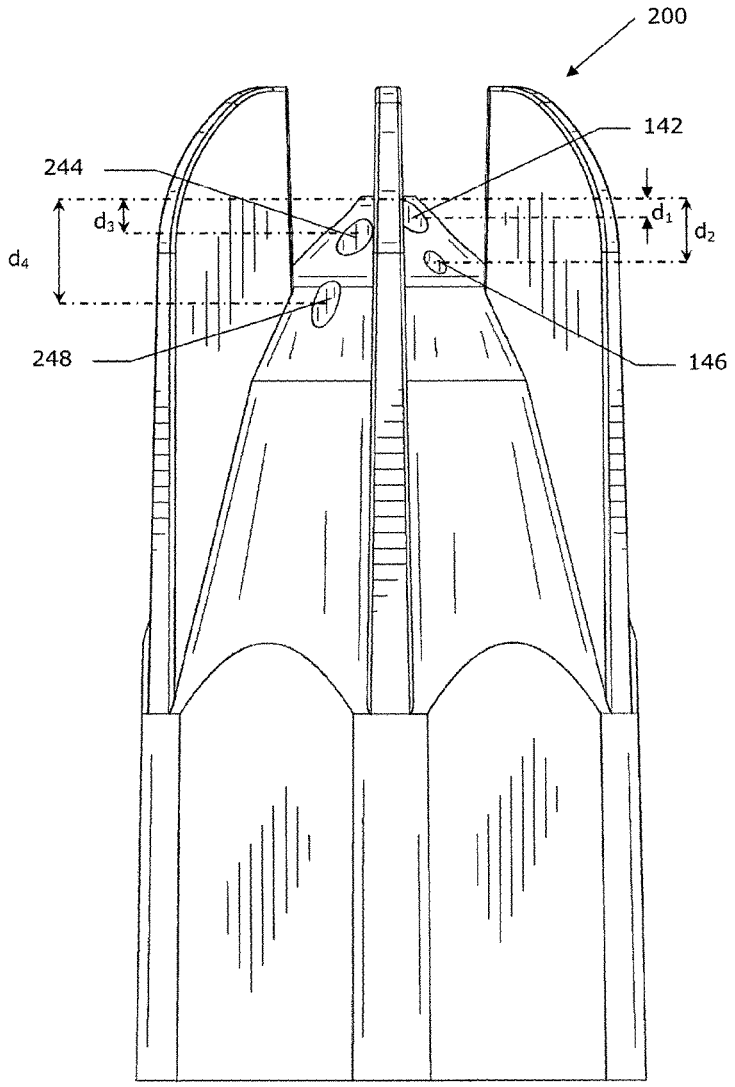
Figure 14:
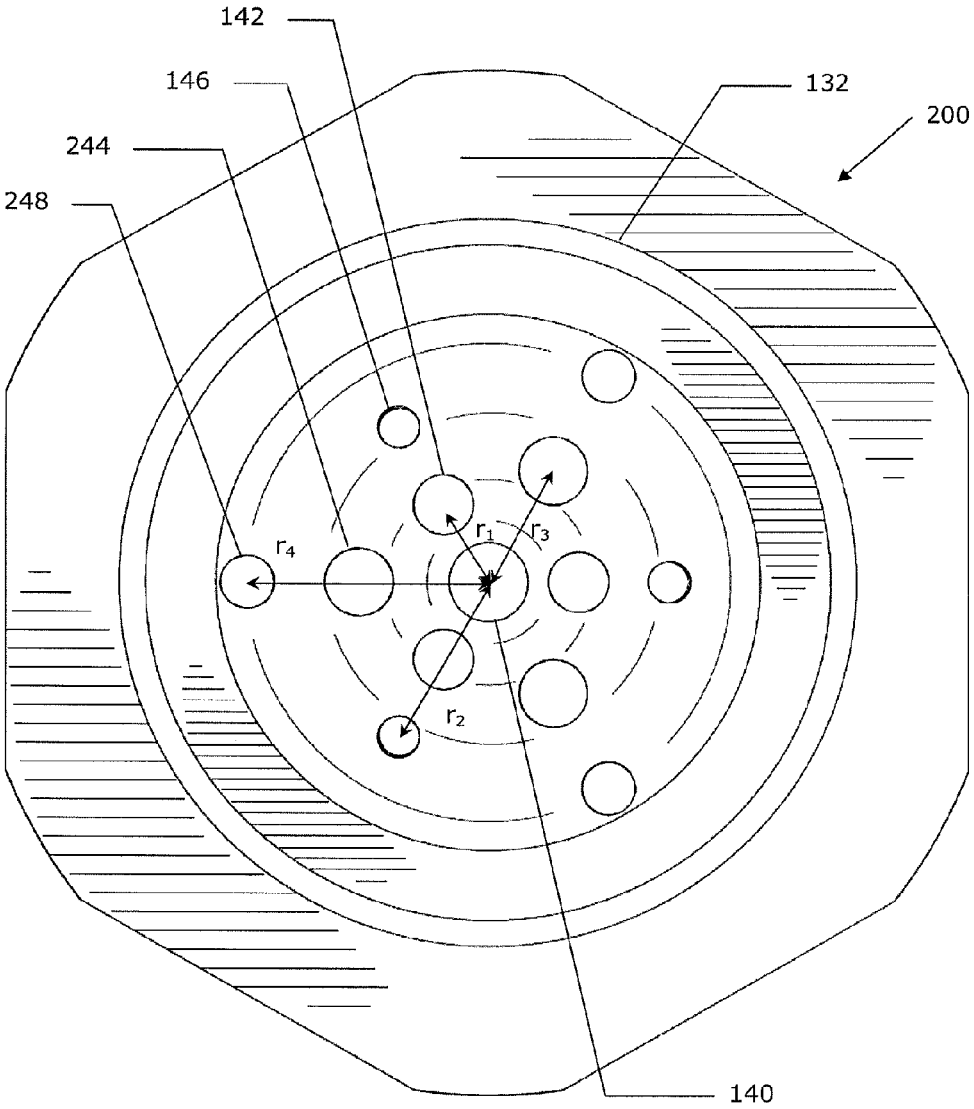
Figure 15:
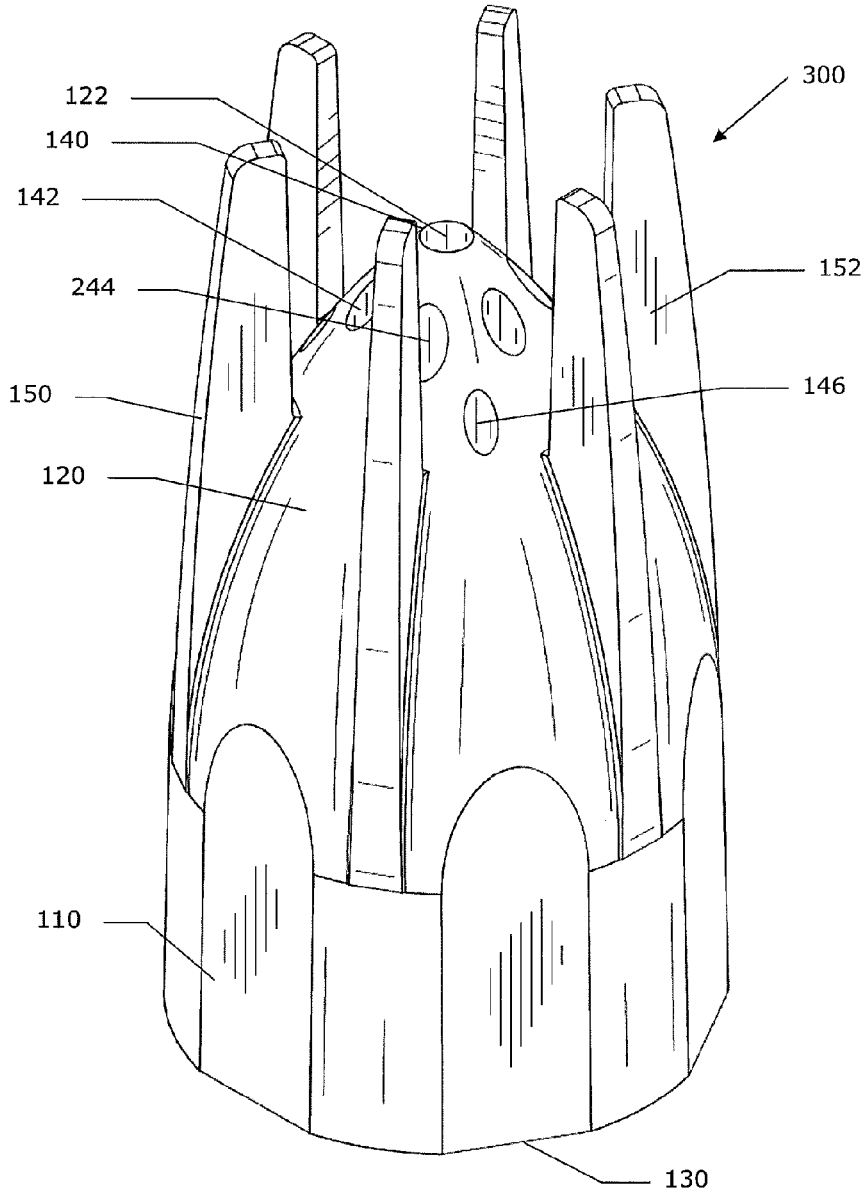
FIGS. 15-16 provide top and bottom perspective views, respectively, of a nozzle according to a third embodiment of the present invention.
Figure 16:
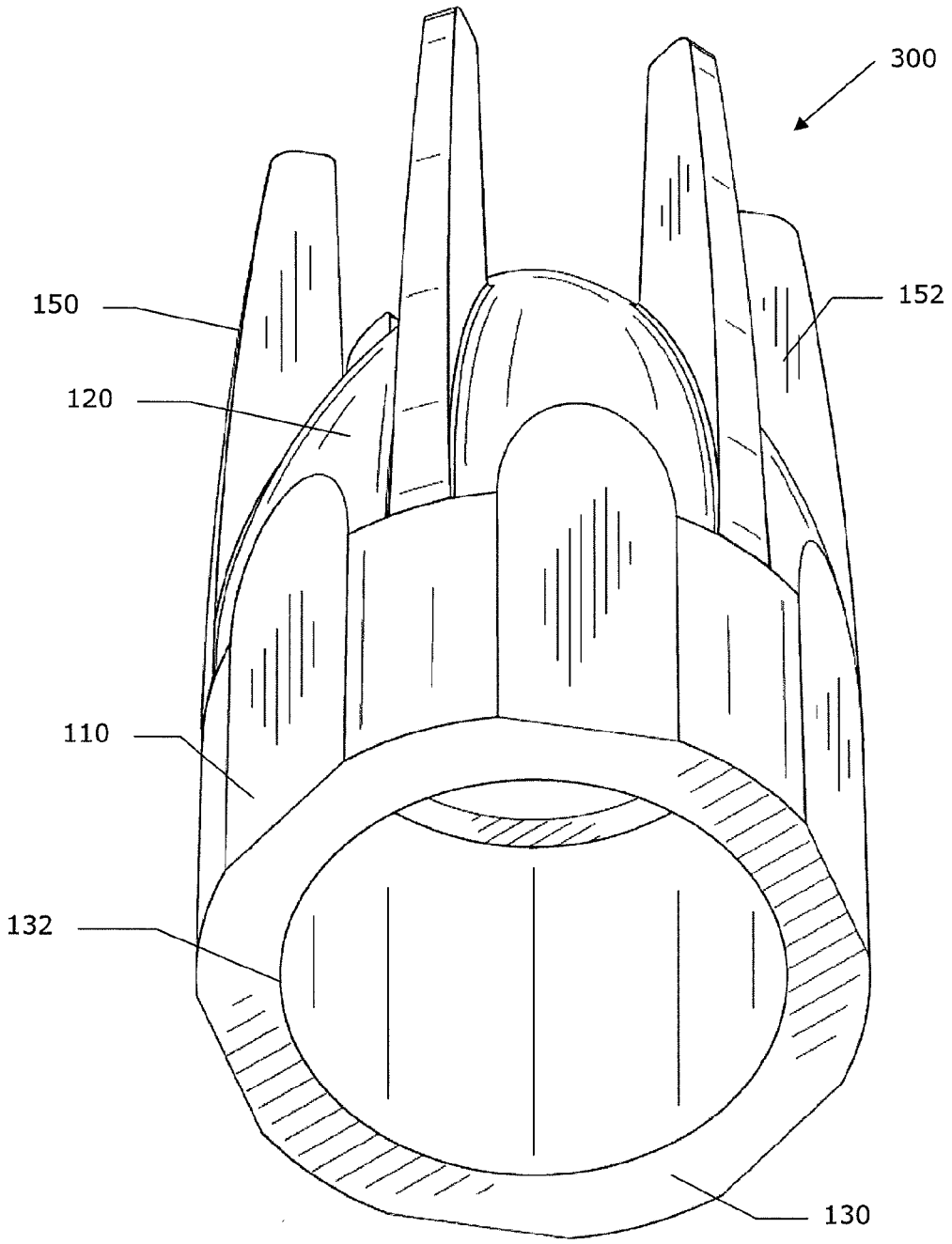
Figure 17:
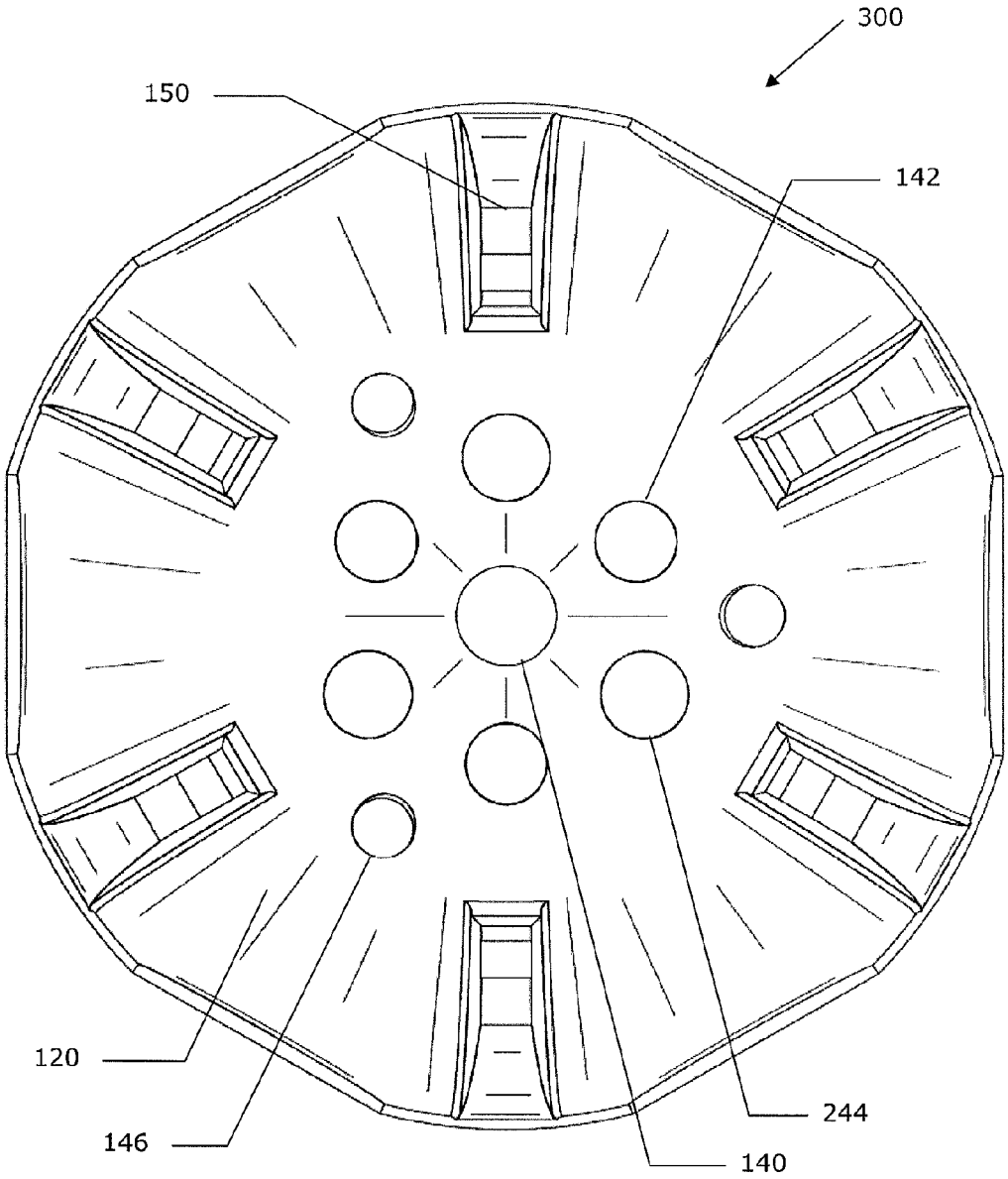
FIGS. 17-21 provide a top (FIG. 17), side (FIG. 18), cross-sectional (FIG. 19), rotated side (FIG. 20), and bottom (FIG. 21) view of the nozzle depicted in FIGS. 15-16.
Figure 18:
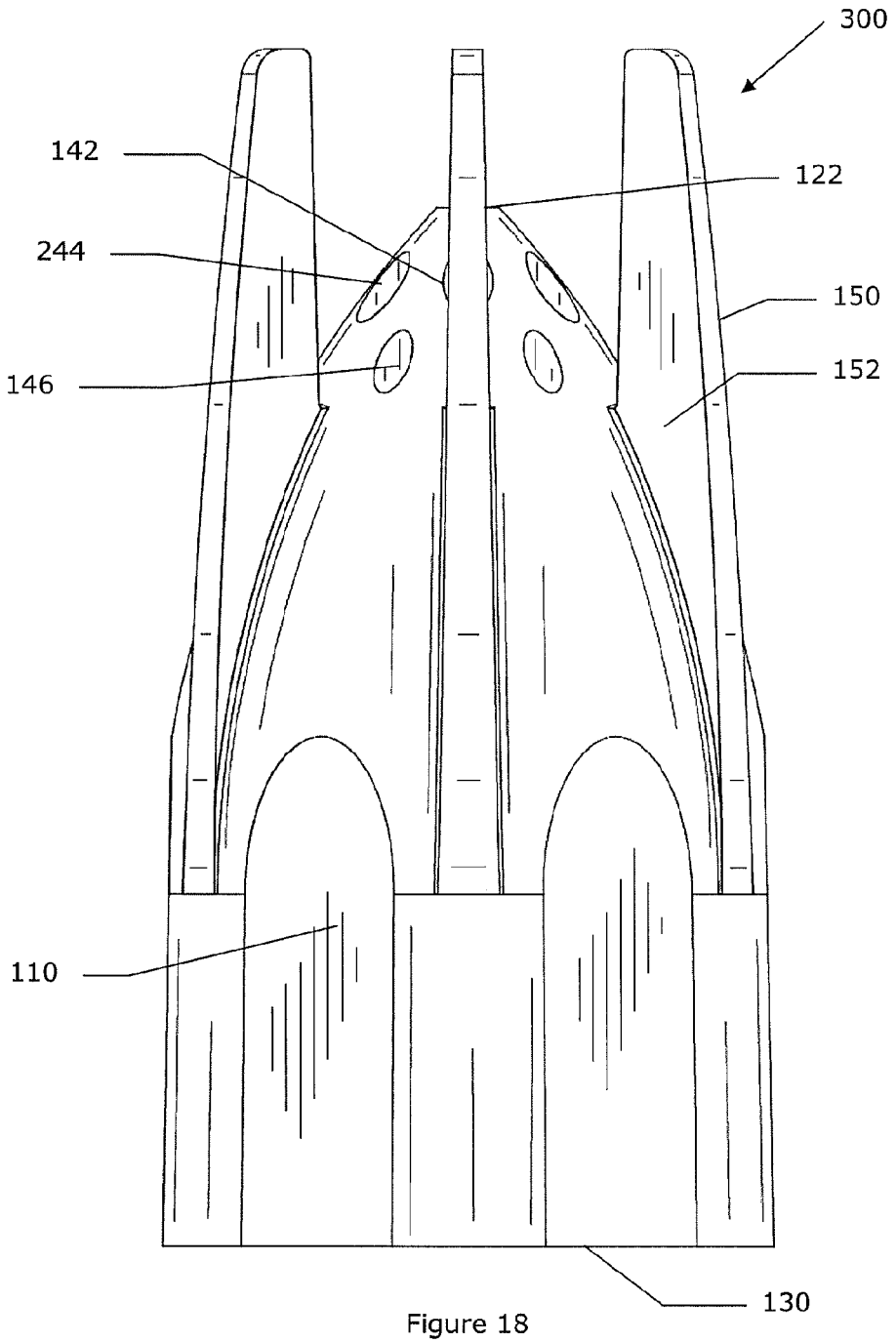
Figure 19:
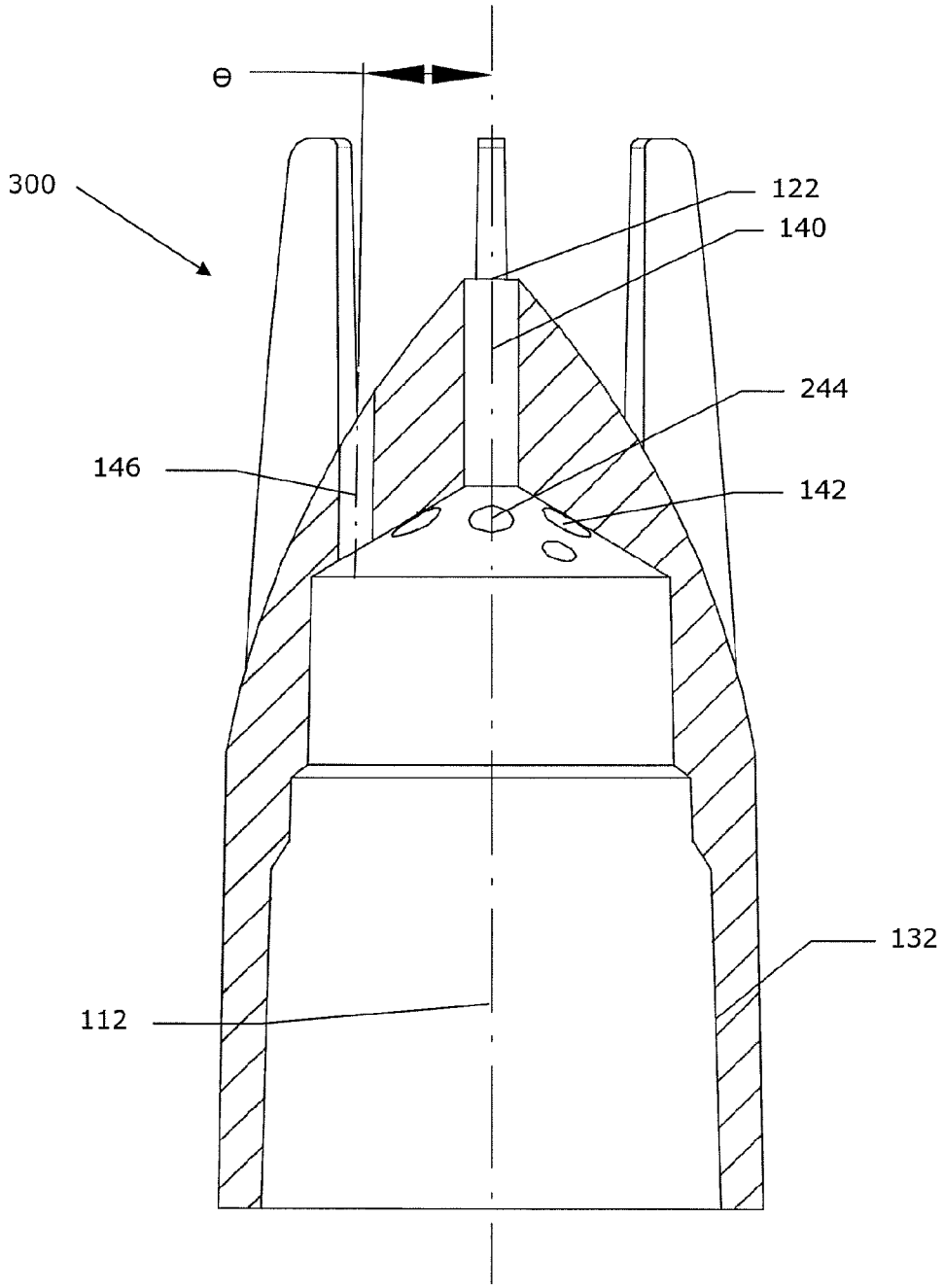
Figure 20:
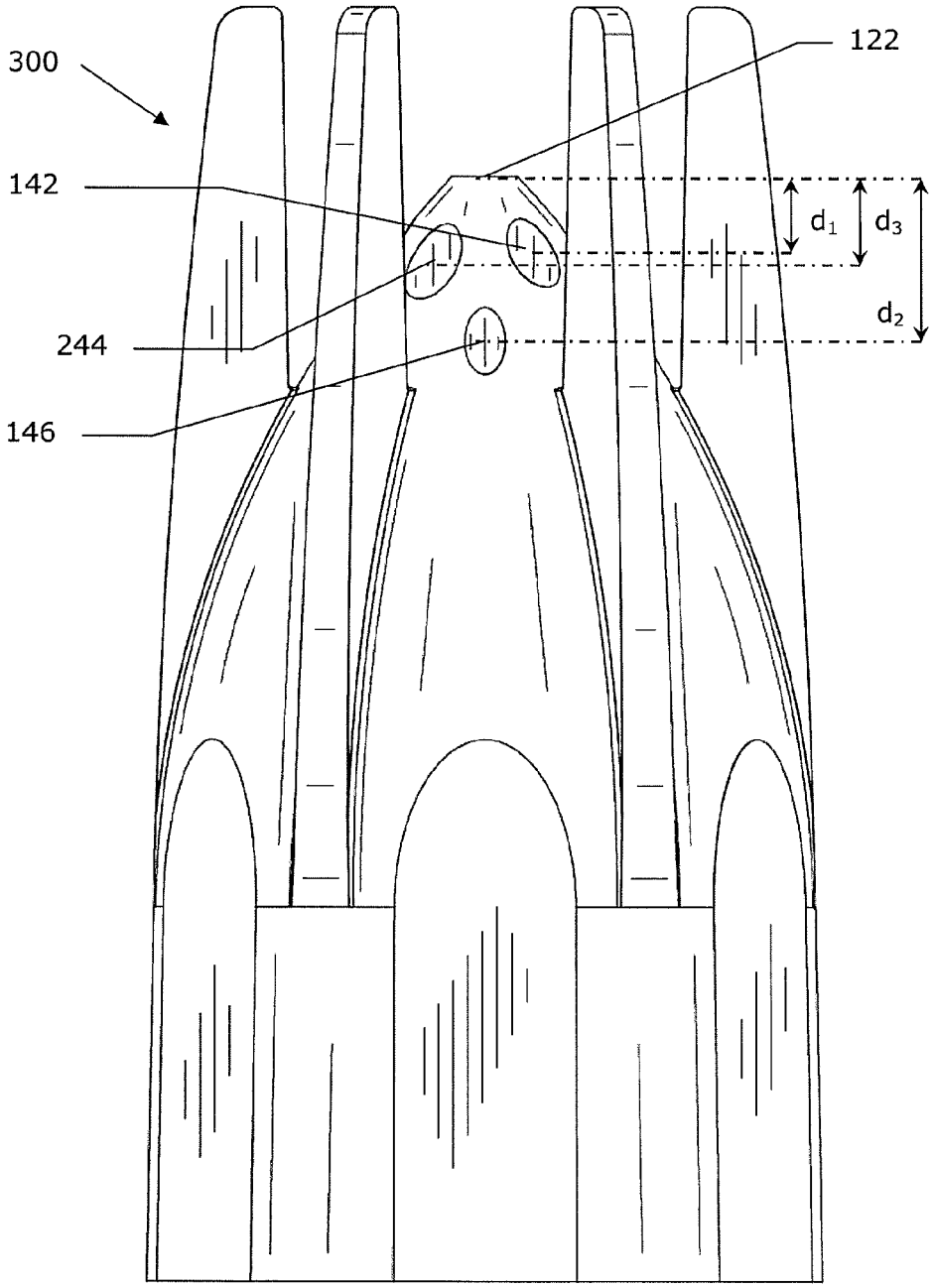
Figure 21:
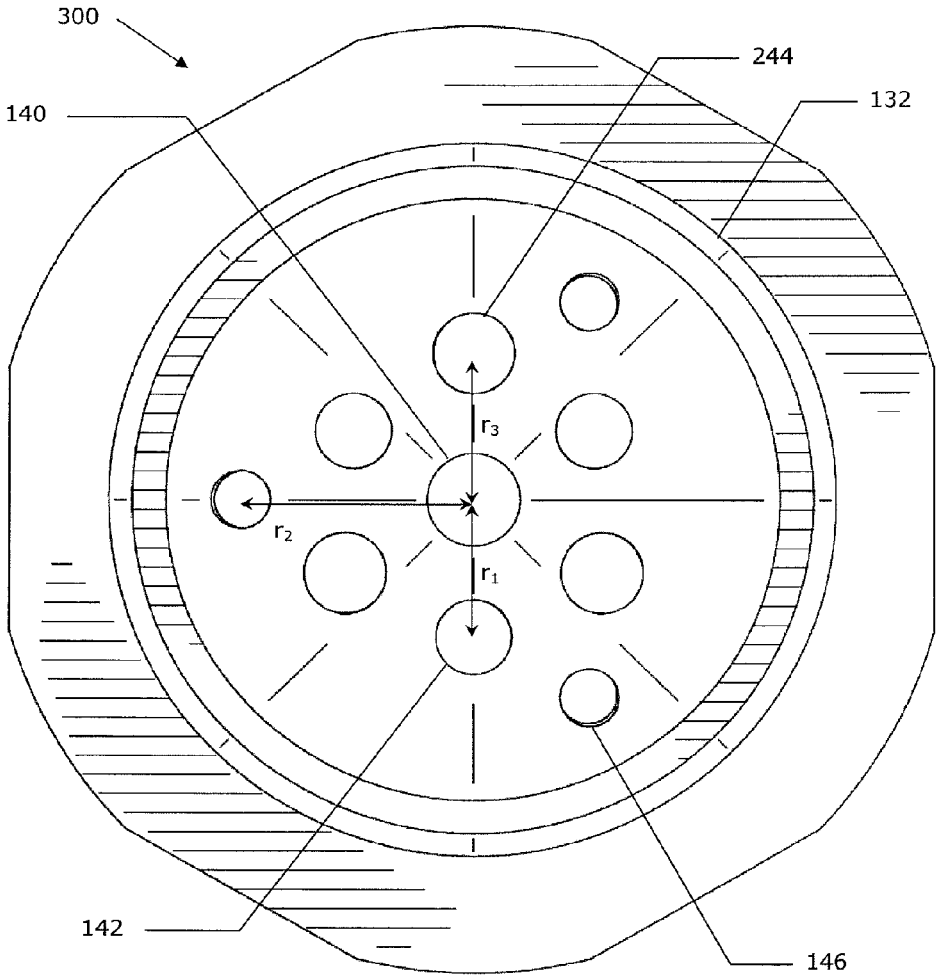
Figure 22:
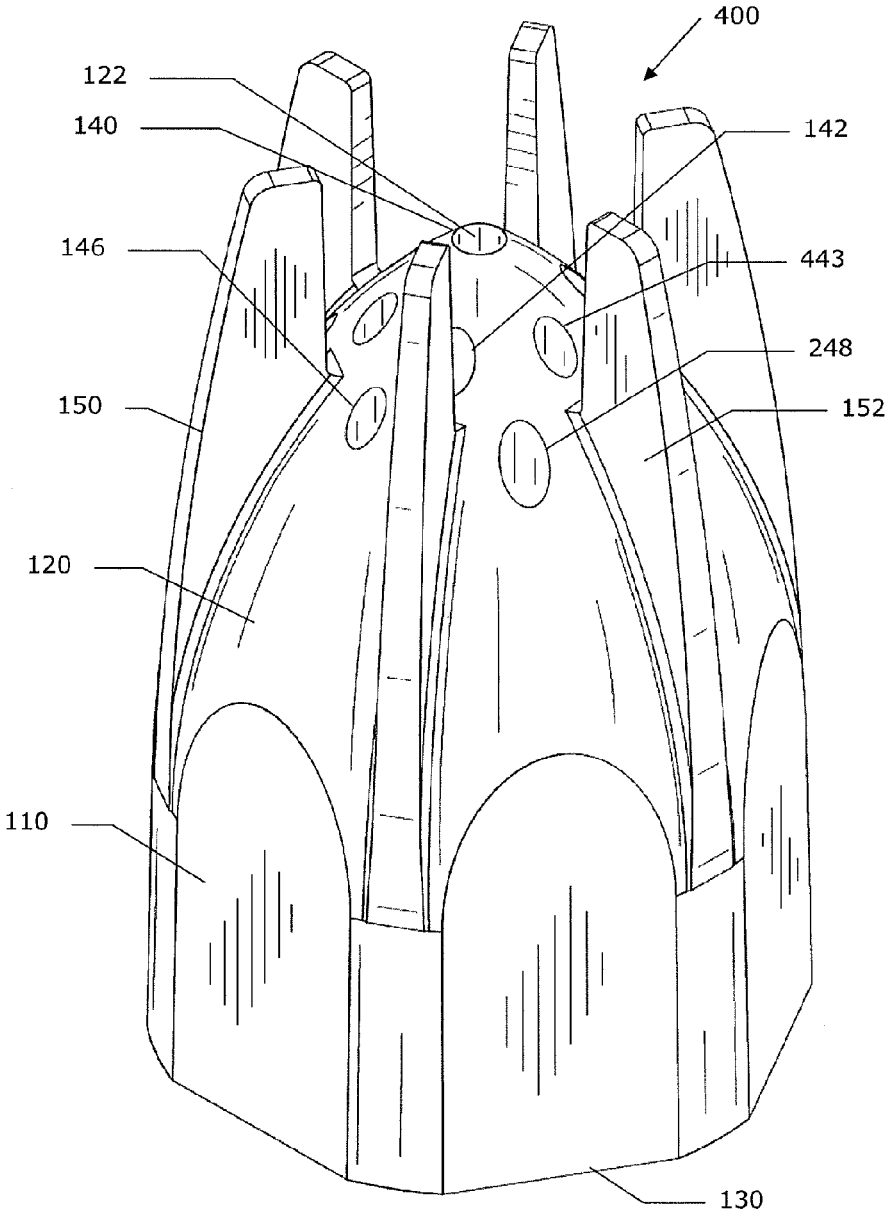
FIGS. 22-23 provide top and bottom perspective views, respectively, of a nozzle according to a fourth embodiment of the present invention.
Figure 23:
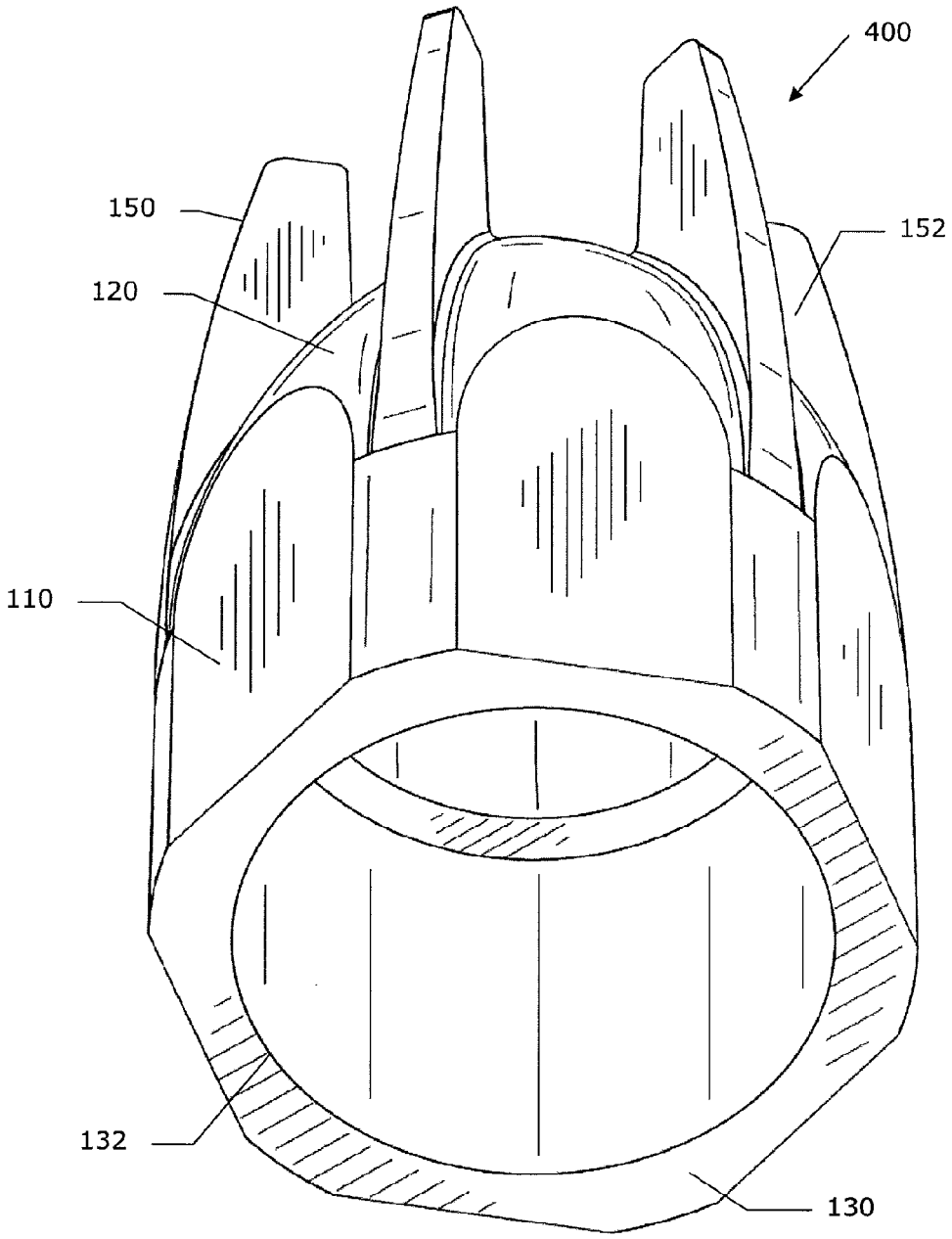

As can be seen in FIG. 14, at least three third outlets 244 are positioned at a third radius ($r_3$) from the blowing axis 112, with the third radius ($r_3$) being greater than the first radius ($r_1$) but less than the second radius ($r_2$). In this embodiment, the third radius ($r_3$) is approximately 44 percent larger than the first radius ($r_1$) and the second radius ($r_2$) is approximately 33 percent larger than the third radius ($r_3$). As seen in FIG. 13, the third outlets are positioned at a third distance ($d_3$) from the apex 122 which is greater than the first distance ($d_1$) but less than the second distance ($d_2$). This results in a concentric arrangement, with the third outlets positioned between the first and second outlets.

Although there is still an overall reduction in outlet size as one moves from the blowing axis 112 to the periphery of the nozzle 200, the diameter of the third outlets 244 is greater than the diameter of the first outlets 142. In this embodiment, the diameter of the third outlets 244 are approximately 13 percent larger than the diameter of the first outlets 142. Here, the third outlets 244 are substantially parallel to the blowing axis 112 and have a total discharge area which is greater than the total discharge area of the first outlets 142.

In this embodiment, at least three fourth outlets 248 are also provided. The fourth outlets are positioned at a fourth radius ($r_4$) from the blowing axis 112, with the fourth radius ($r_4$) being greater than the second radius ($r_2$). In this embodiment, the fourth radius ($r_4$) is approximately 33 percent larger than the second radius ($r_2$). Likewise, the fourth outlets are positioned at a fourth distance ($d_4$) from the apex 122 which is greater than the second distance ($d_2$). This results in a concentric arrangement, with the fourth outlets 248 positioned outside of the second outlets 146.

Again, although there is an overall reduction in outlet size as one moves from the blowing axis 112 to the periphery of the nozzle 200, the diameter of the fourth outlets 248 is greater than the diameter of the second outlets 146. In this embodiment, the diameter of the fourth outlets 248 is approximately 27 percent larger than the diameter of the second outlets 146. Here, the fourth outlets 248 are substantially parallel to the blowing axis 112 and have a total discharge area which is greater than the total discharge area of the second outlets 146.

Without committing to a particular theory, the introduction of third and fourth outlets 244, 248 to the nozzle 200 is believed to enhance the rate at which ambient gases are entrained into the flow generated by the nozzle 200. More specifically, the addition of third and fourth outlets 244, 248 is believed to draw ambient gases toward the blowing axis 112 in stages, with each ring of outlets successively transferring gases to a ring of outlets closer to the apex 122 in a step like manner (i.e. fourth outlets to second outlets to third outlets to first outlets to central outlet). Thus, each step reduces the distance to the apex 122 and the radius to the blowing axis 112. The variation of the diameter of the outlets is believed to enhance this effect.

In the nozzle 200 shown in FIGS. 8-14, the first, third, second and fourth outlets 142, 244, 146, 248 are offset relative to one another, such that each outlet is positioned halfway between two outlets of the previous, inner ring. A one-half sequential offset is preferred, however various other forms of offset are also contemplated, including ⅓ and ¼ offsets.

FIGS. 15-21 provide a nozzle 300 according to a third embodiment of the present invention. In this embodiment, the fourth outlets 248 are omitted.

In general terms, the nozzle 300 consists of an elongate nozzle body 110 having a blowing end 120 and a supply end 130. The blowing end 120 of the nozzle 300 is substantially parabolic. A series of outlets 140, 142, 244, 146 are provided (See FIG. 17) on the blowing end 120 for generating a flow of compressed gas along a blowing axis 112 (See FIG. 19). An inlet 132 is provided on the supply end 130 for supplying compressed gases to the nozzle 100. In this embodiment, the inlet 132 is a 0.75" NPT connector.

As with the other nozzles 100, 200 described above, the nozzle 300 in FIGS. 15-21 has a central outlet 140 at an apex 122, first outlets 142 disposed about the central outlets at a first distance ($d_1$) and first radius ($r_1$), and second outlets 146 positioned below the first outlets at a second distance ($d_2$) and a second radius ($r_2$). Each of these features are analogous to those described for nozzle 100 above.

In this embodiment, the first outlets 142 have a diameter which is approximately 19 percent smaller than the central outlet 140 and the diameter of the second outlets 146 is approximately 23 percent smaller than the first outlets 142. Likewise, the second radius ($r_2$) is approximately 2.7-fold larger than the first radius ($r_1$). The second outlets 146 are angled inward at an angle ($\theta$) of 1.0 degrees. Fins 150 are also present on this embodiment, the surfaces 152 of which extend beyond the apex 122 of the nozzle 300.

Third outlets 244 are also provided, which are largely analogous to those described above for nozzle 200 depicted in FIGS. 8-14. In this embodiment, the third radius ($r_3$) is approximately 7 percent larger than the first radius ($r_1$) and the second radius ($r_2$) is approximately 1.6-fold larger than the third radius ($r_3$). The diameter of the third outlets 244 is also larger than the first outlets 142, in this case by approximately 8 percent.

FIGS. 22-28 provide a nozzle 400 according to a fourth embodiment of the present invention. In this embodiment, three further outlets 443 are provided on a further radius ($r_f$), which in this embodiment is equal to the first radius ($r_1$). In addition, both the second outlets 146 and the fourth outlets 248 are positioned between pairs of fins 150.

In general terms, the nozzle 400 consists of an elongate nozzle body 110 having a blowing end 120 and a supply end 130. The blowing end 120 of the nozzle 400 is substantially parabolic. A series of outlets 140, 142, 443, 146, 248 are provided (See FIG. 24) on the blowing end 120 for generating a flow of compressed gas along a blowing axis 112 (See FIG. 26). An inlet 132 is provided on the supply end 130 for supplying compressed gases to the nozzle 100. In this embodiment, the inlet 132 is a 1" NPT connector.

As with the other nozzles 100, 200, 300 described above, the nozzle 400 in FIGS. 22-28 has a central outlet 140 at an apex 122, first outlets 142 disposed about the central outlets at a first distance ($d_1$) and first radius ($r_1$), and second outlets 146 positioned below the first outlets at a second distance ($d_2$) and a second radius ($r_2$). Each of these features are analogous to those described for nozzle 100 above.

In this embodiment, the first outlets 142 have a diameter which is approximately 19 percent smaller than the central outlet 140 and the diameter of the second outlets 146 is approximately 12 percent smaller than the first outlets 142. Likewise, the second radius ($r_2$) is approximately 1.5-fold larger than the first radius ($r_1$). The second outlets 146 are angled inward at an angle ($\theta$) of 1.0 degrees. Fins 150 are also present on this embodiment, the surfaces 152 of which extend beyond the apex 122 of the nozzle 400.

Figure 24:
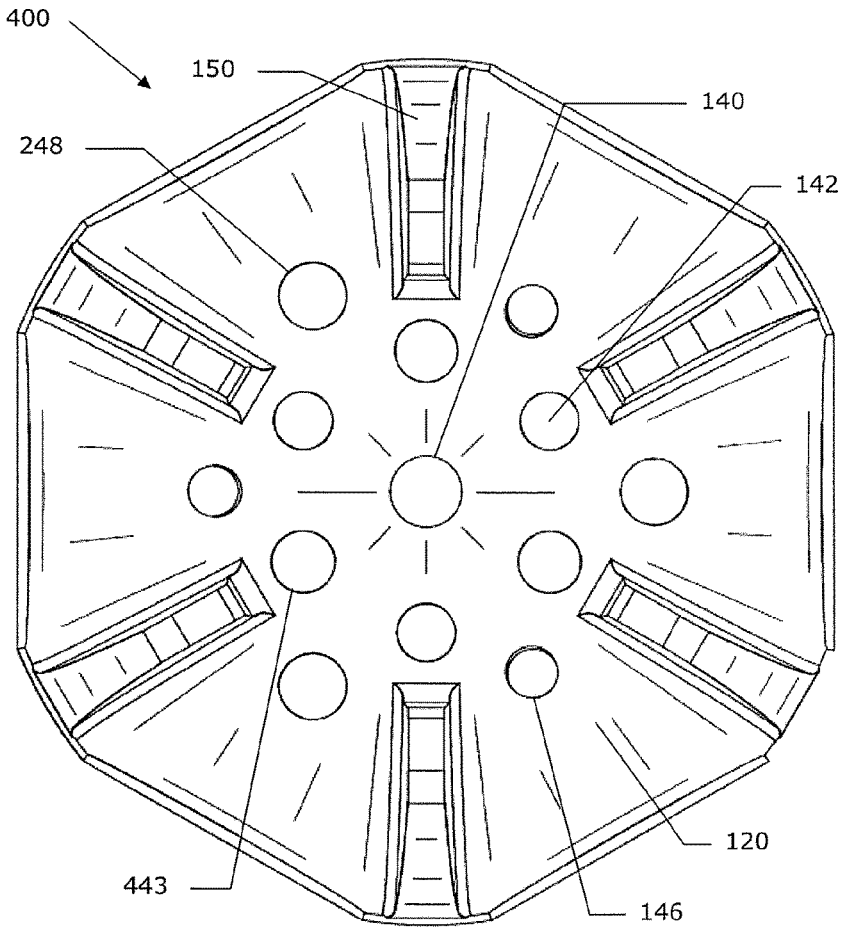
FIGS. 24-28 provide a top (FIG. 24), side (FIG. 25), cross-sectional (FIG. 26), rotated side (FIG. 27), and bottom (FIG. 28) view of the nozzle depicted in FIGS. 22-23.
Figure 25:
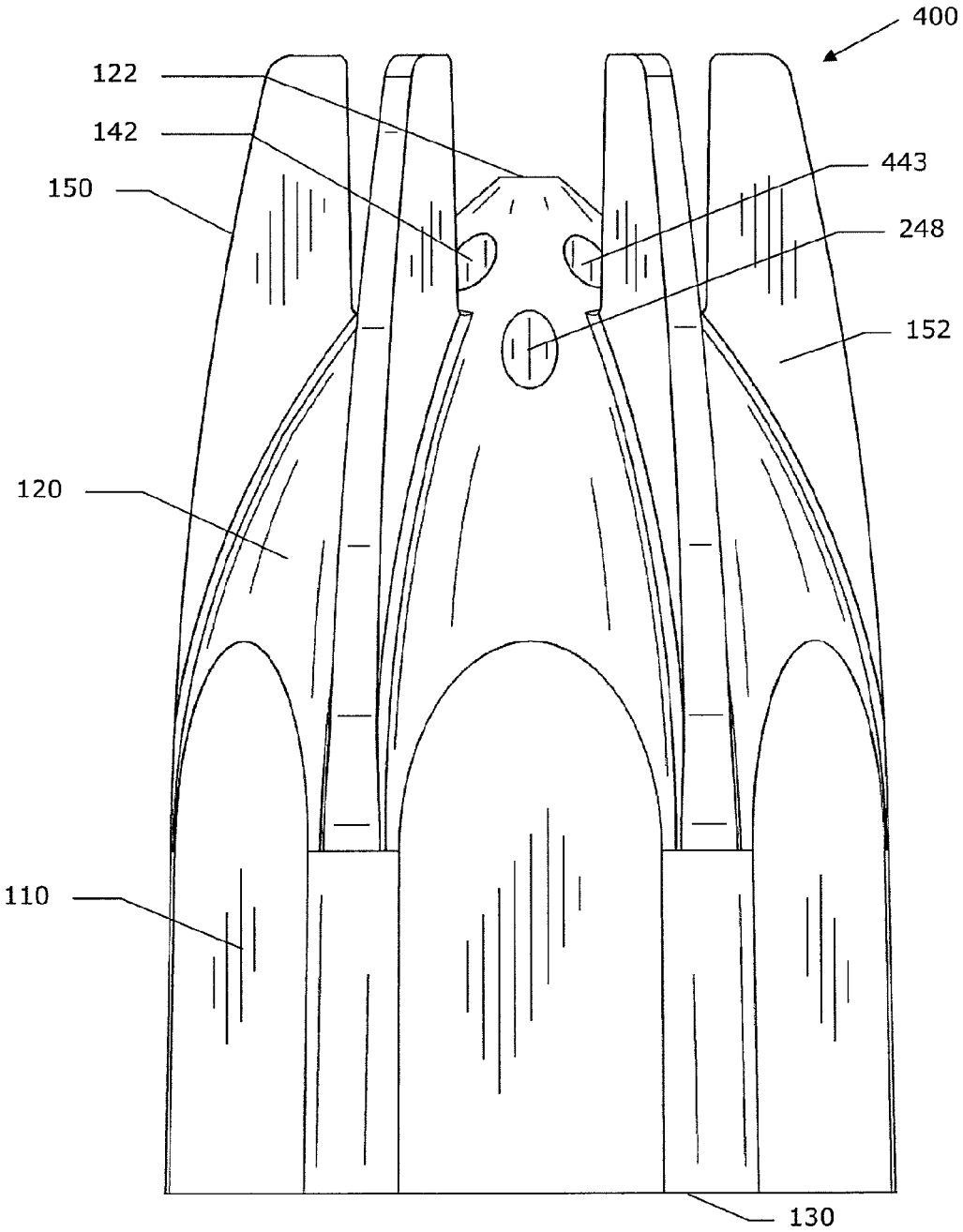
Figure 26:
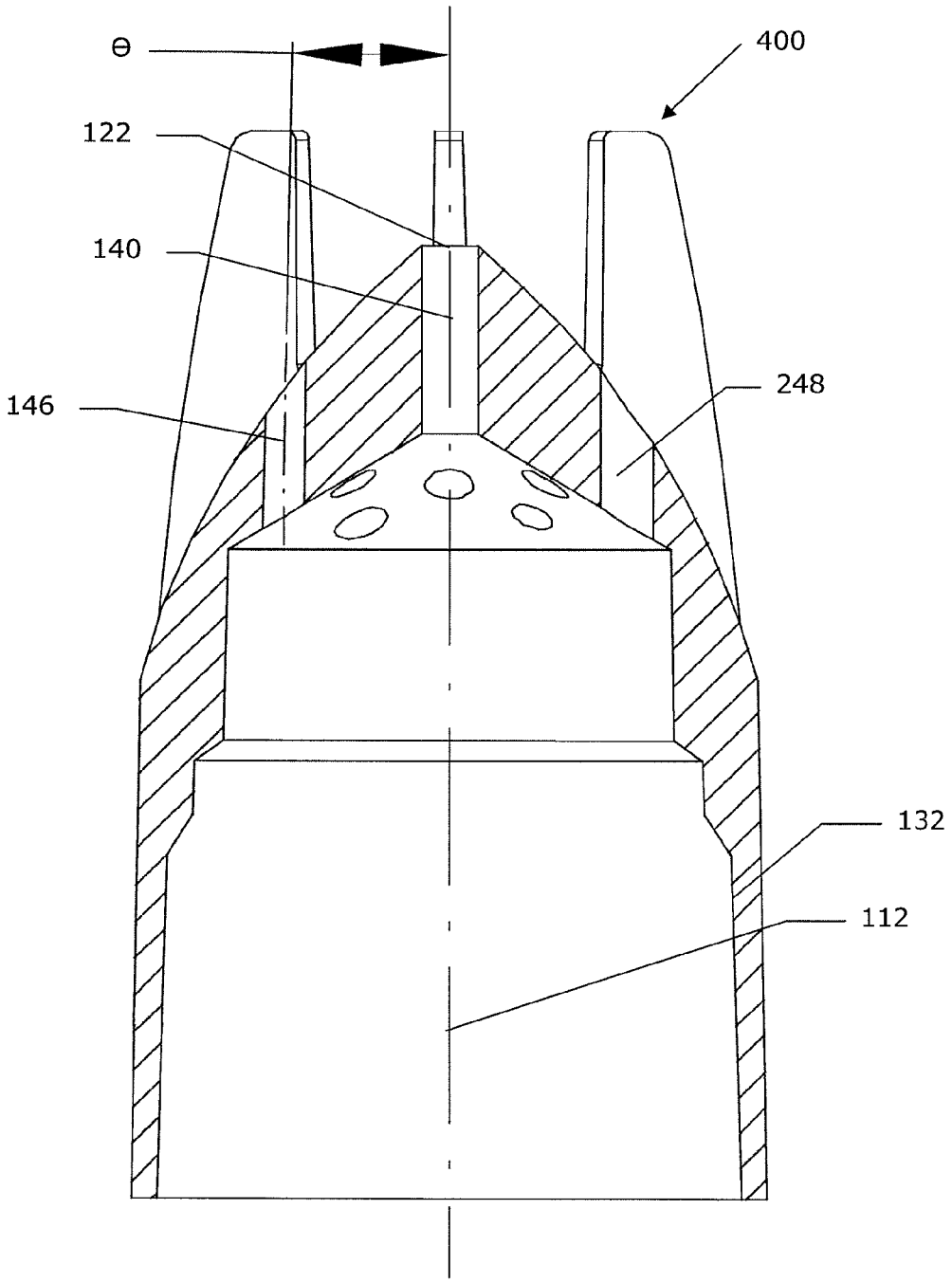
Figure 27:
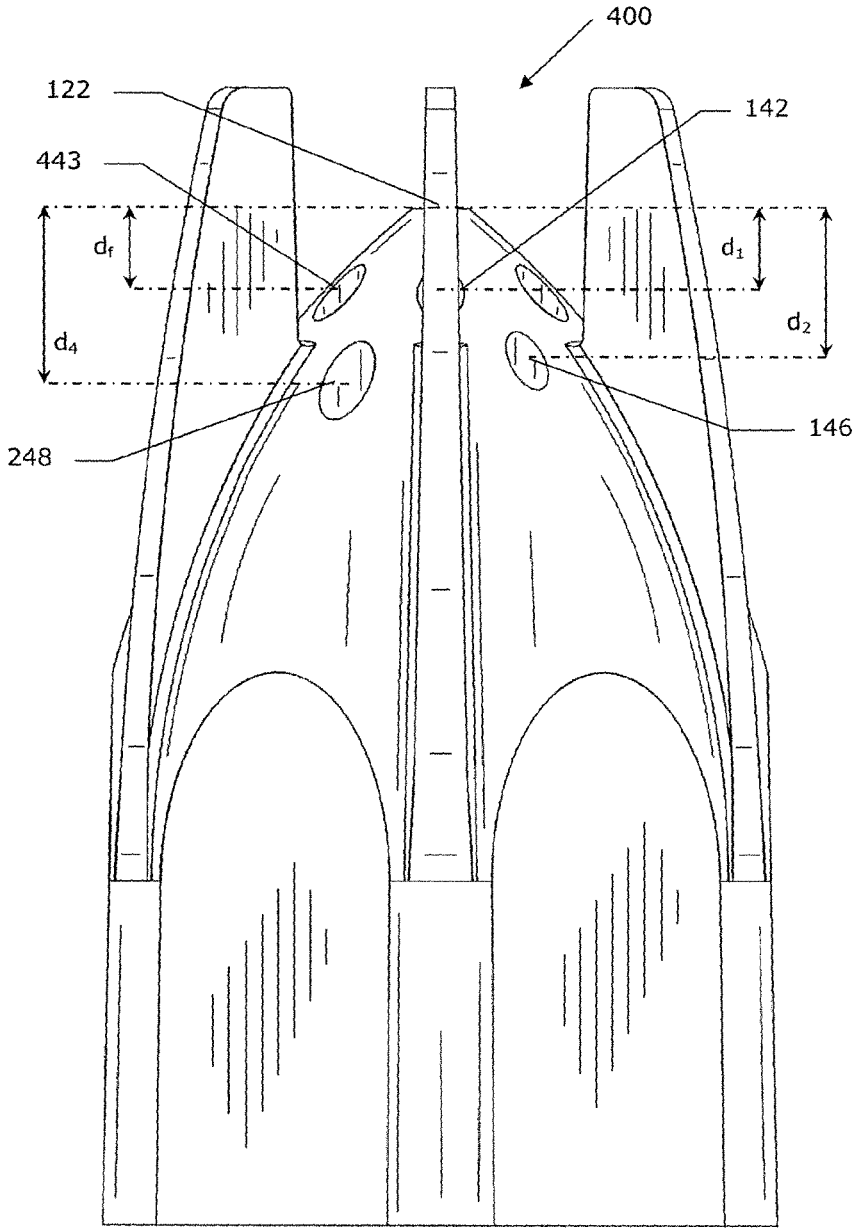
Figure 28:
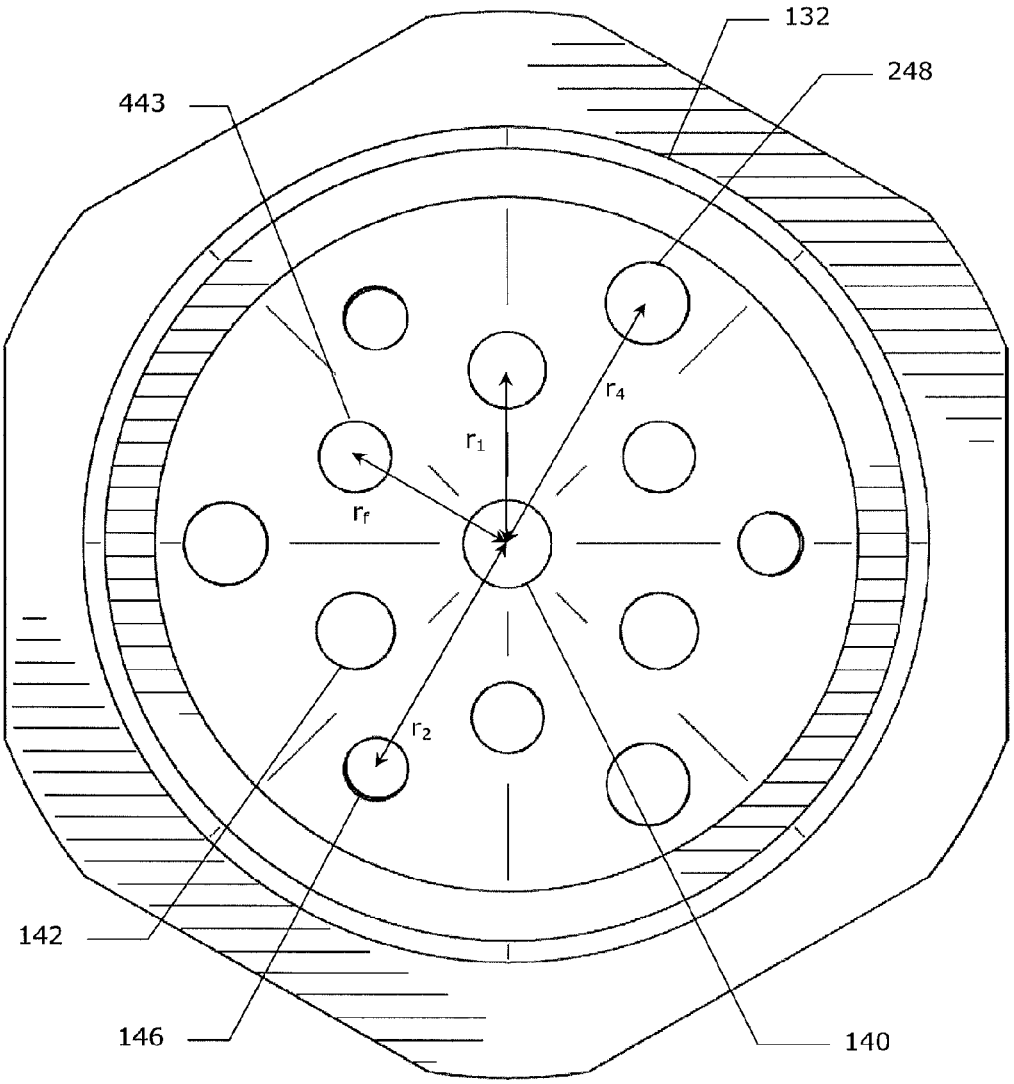
Figure 29:
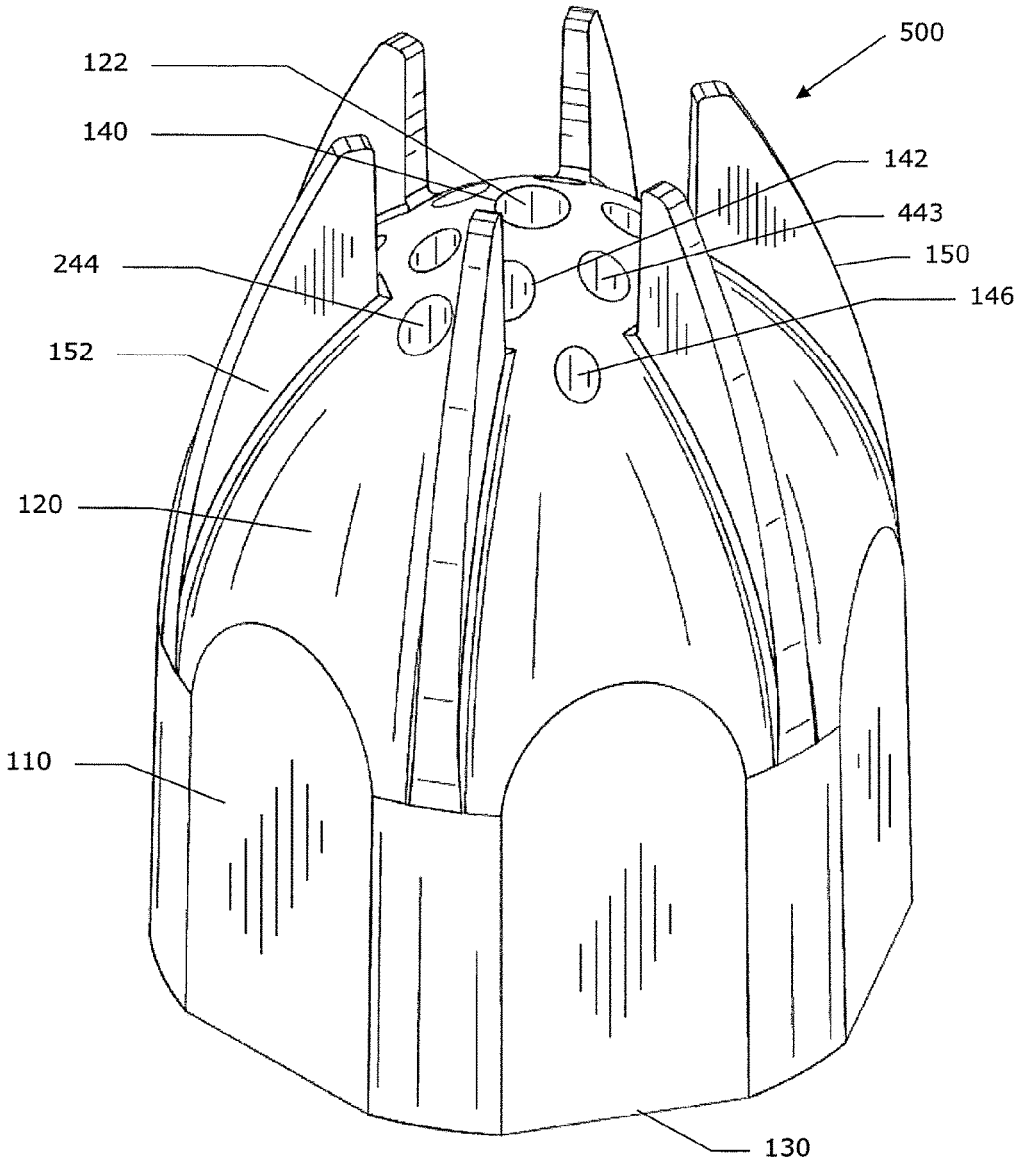
FIGS. 29-30 provide top and bottom perspective views, respectively, of a nozzle according to a fifth embodiment of the present invention.
Figure 30:
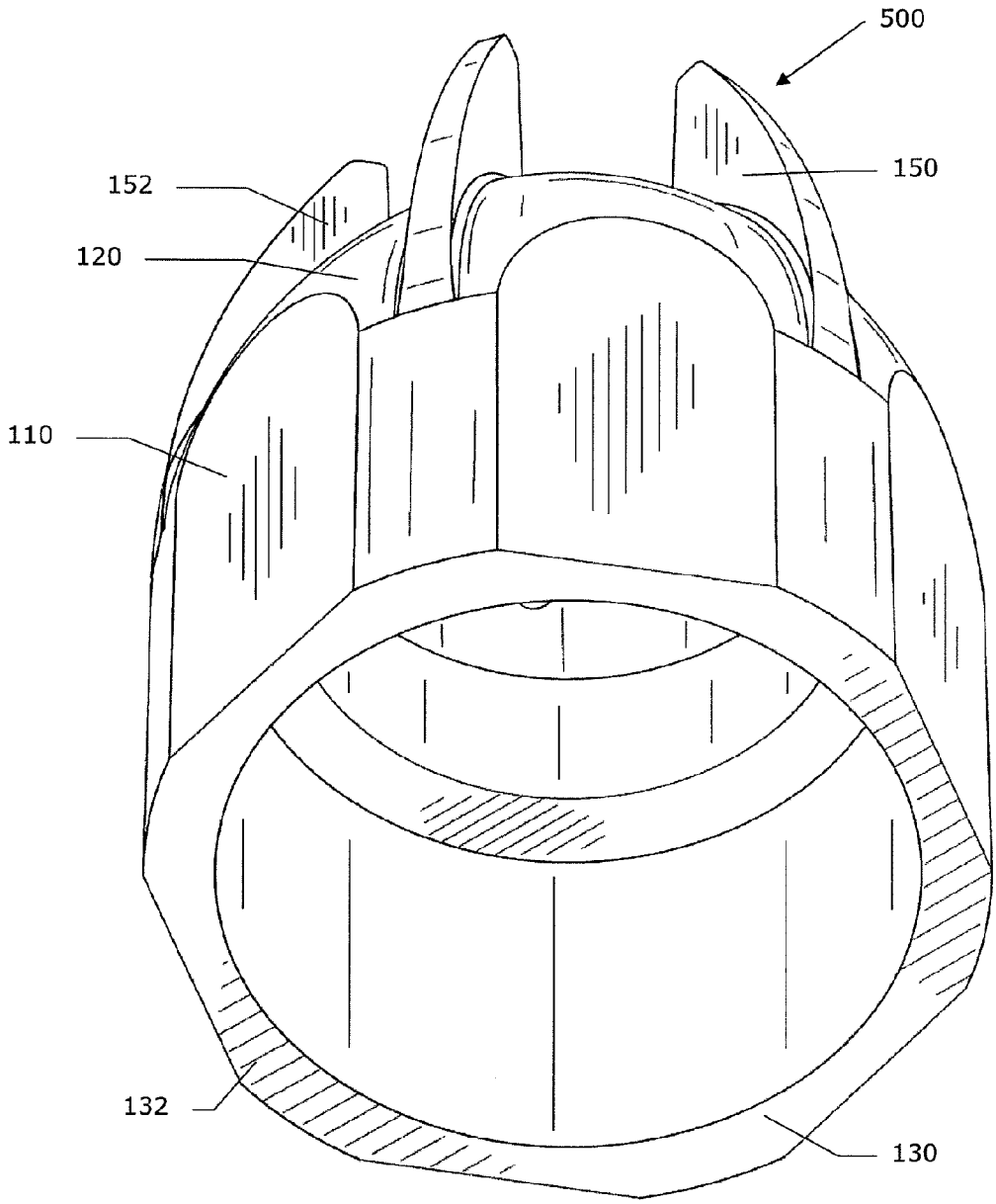
Figure 31:
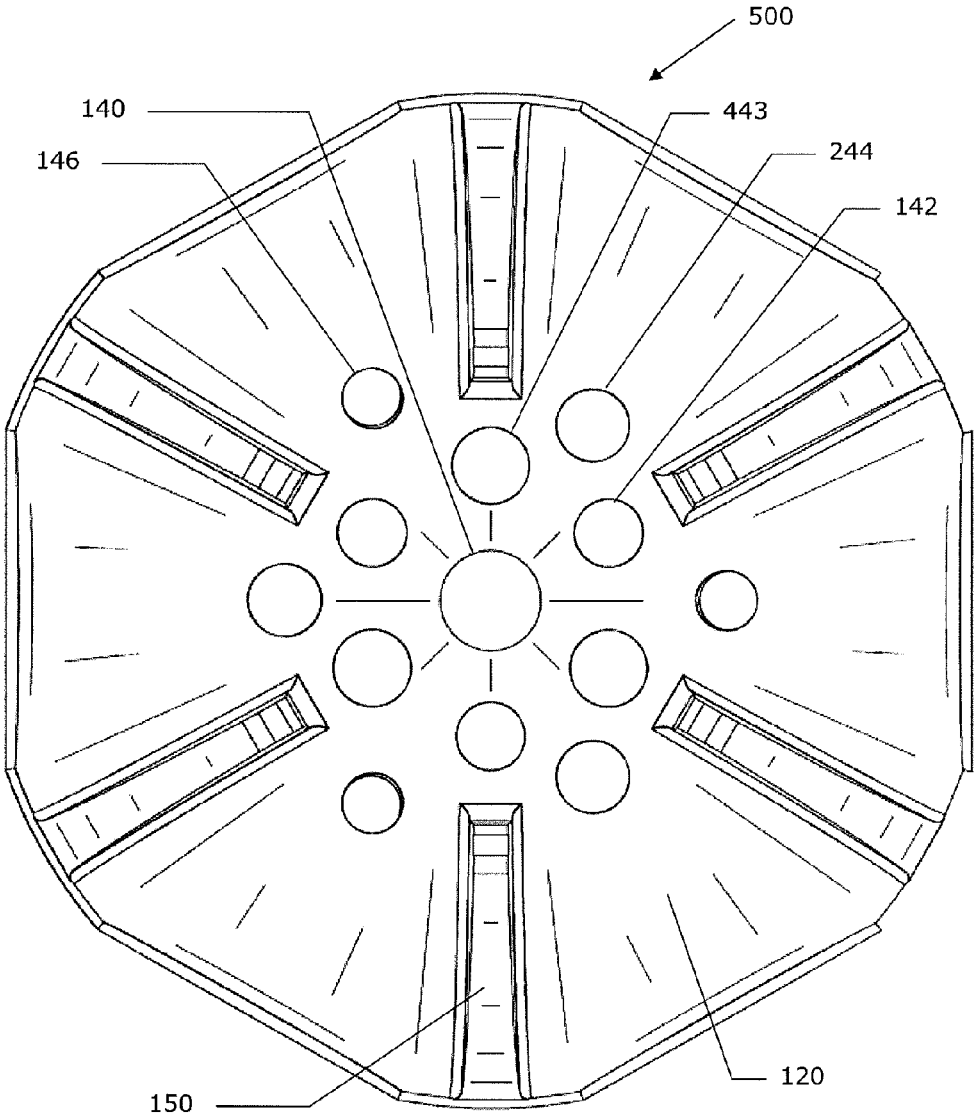
FIGS. 31-35 provide a top (FIG. 31), side (FIG. 32), cross-sectional (FIG. 33), rotated side (FIG. 34), and bottom (FIG. 35) view of the nozzle depicted in FIGS. 29-30.
Figure 32:
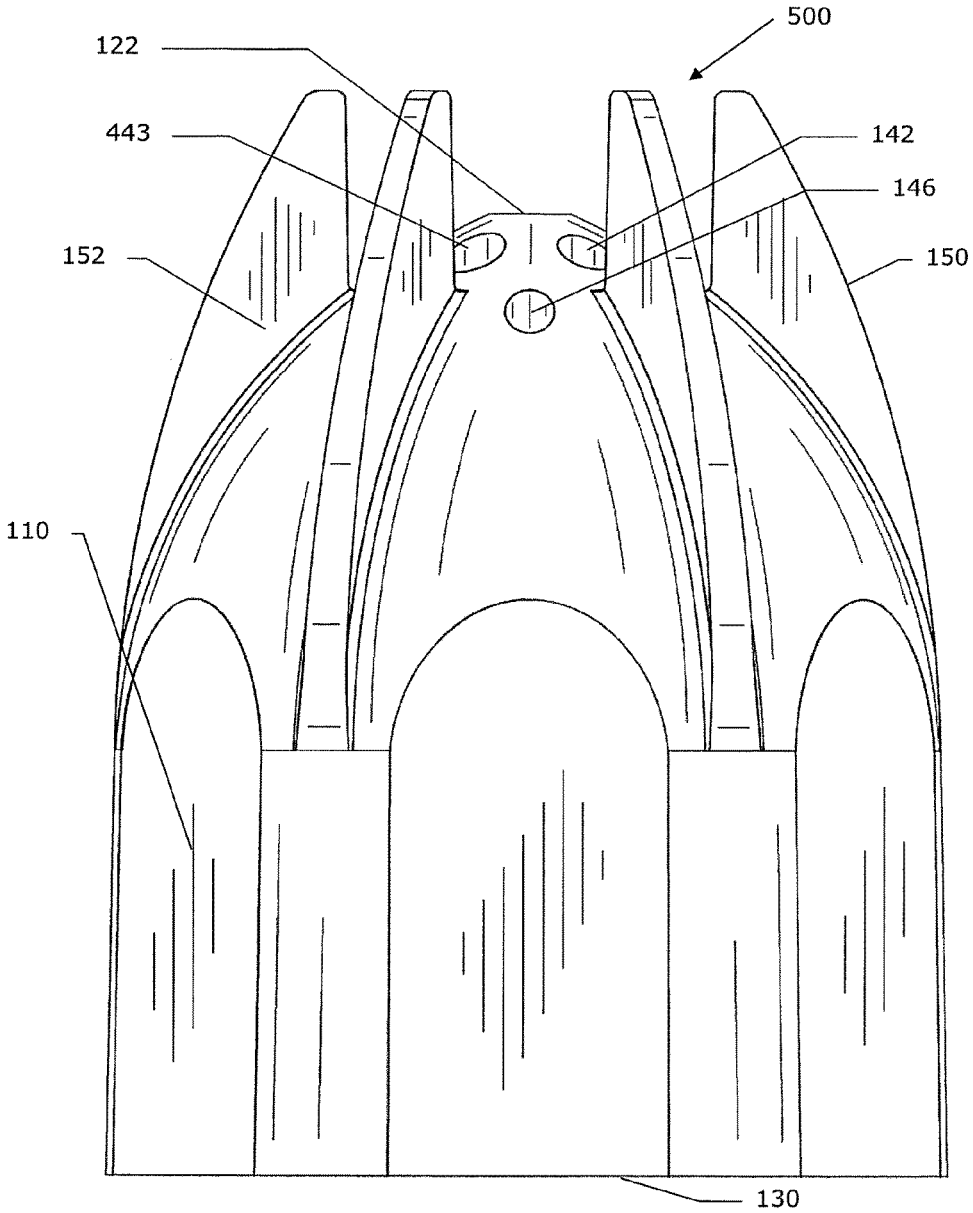
Figure 33:
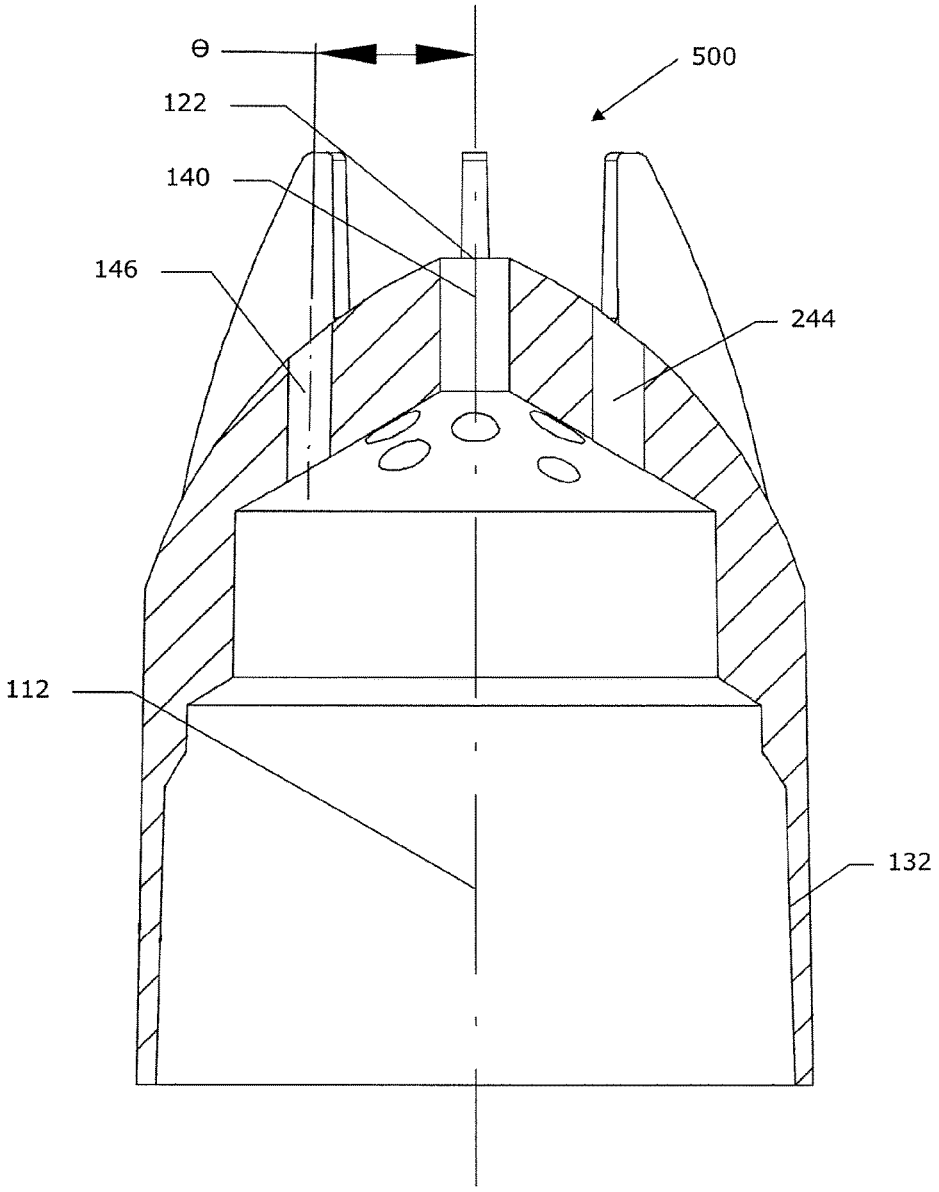
Figure 34:
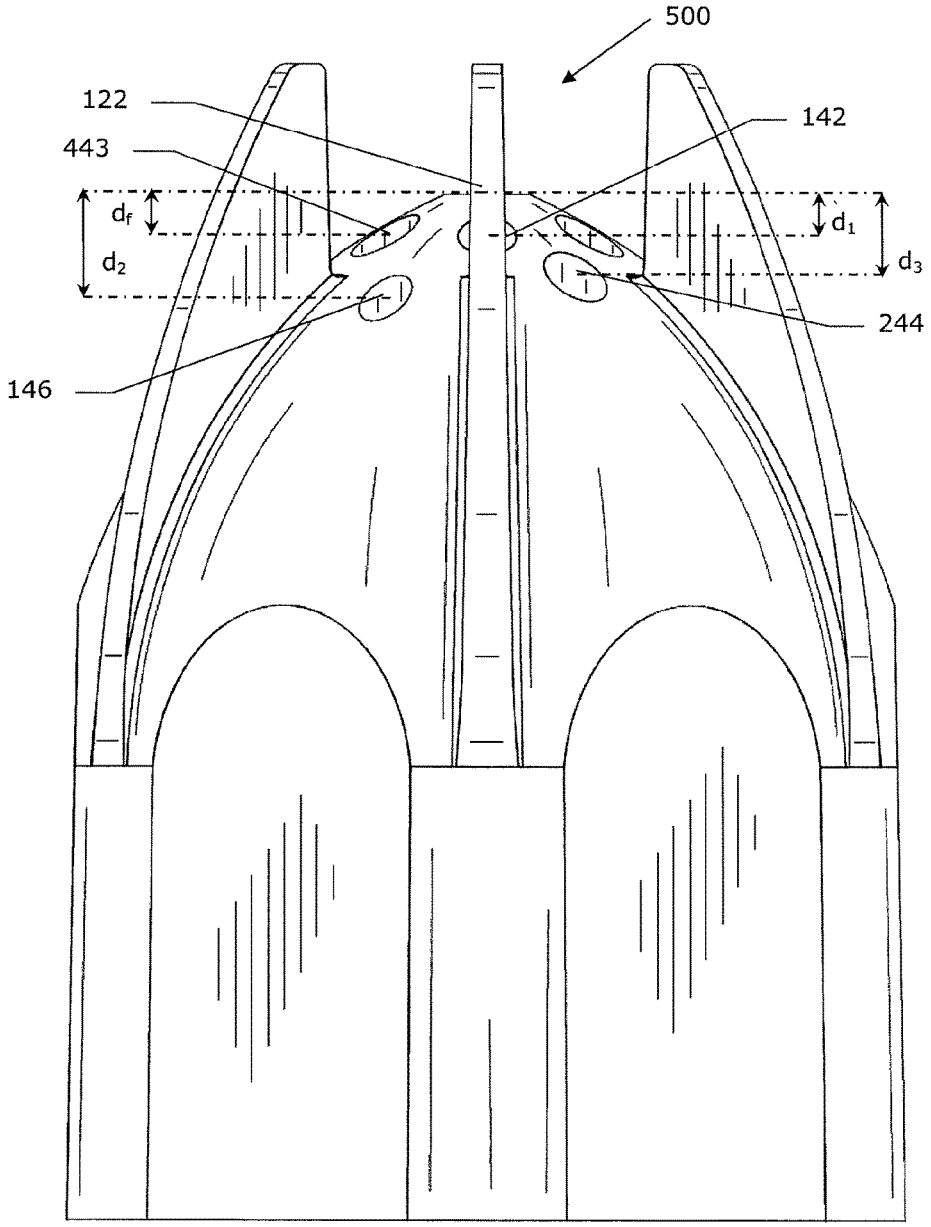
Figure 35:
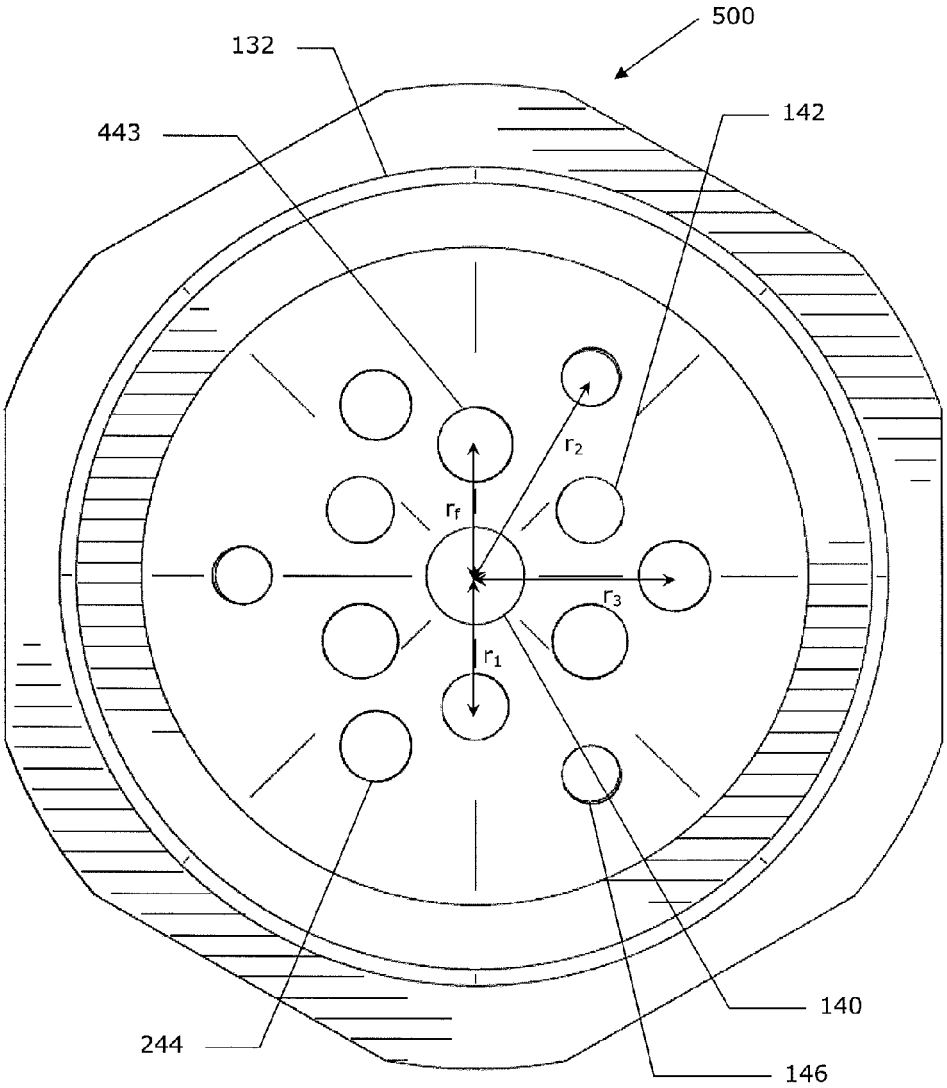
Figure 36:
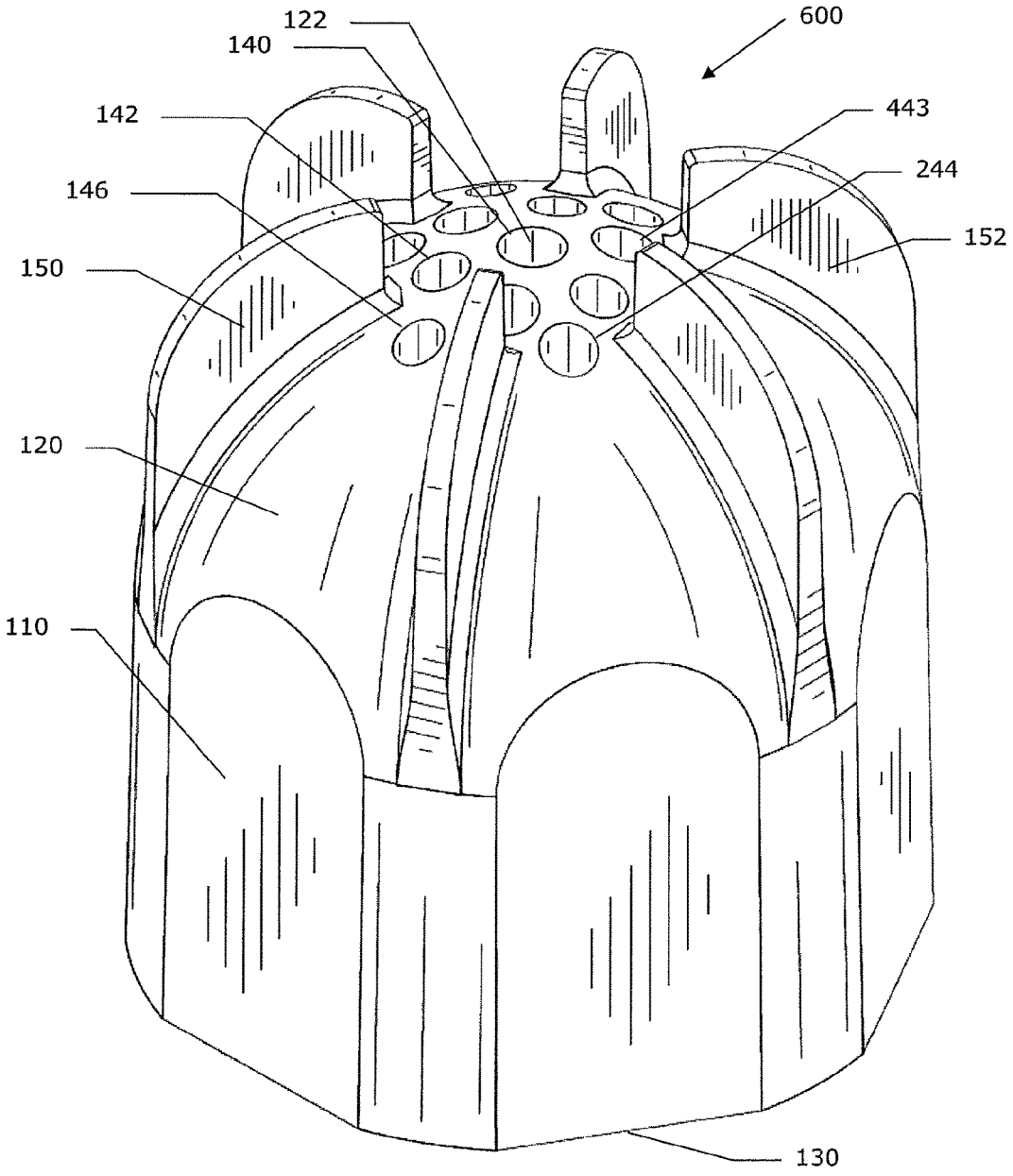
FIGS. 36-37 provide top and bottom perspective views, respectively, of a nozzle according to a sixth embodiment of the present invention.
Figure 37:
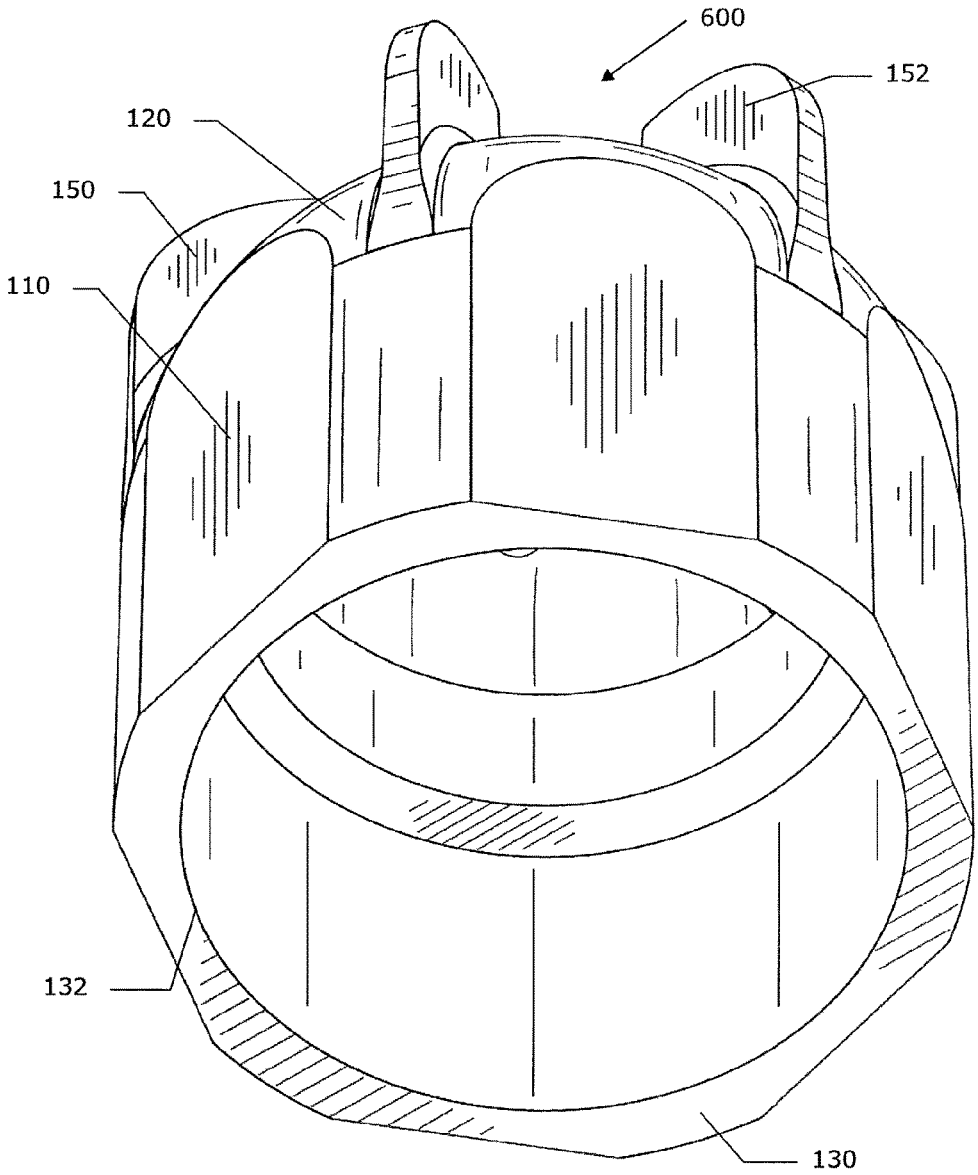
Figure 38:
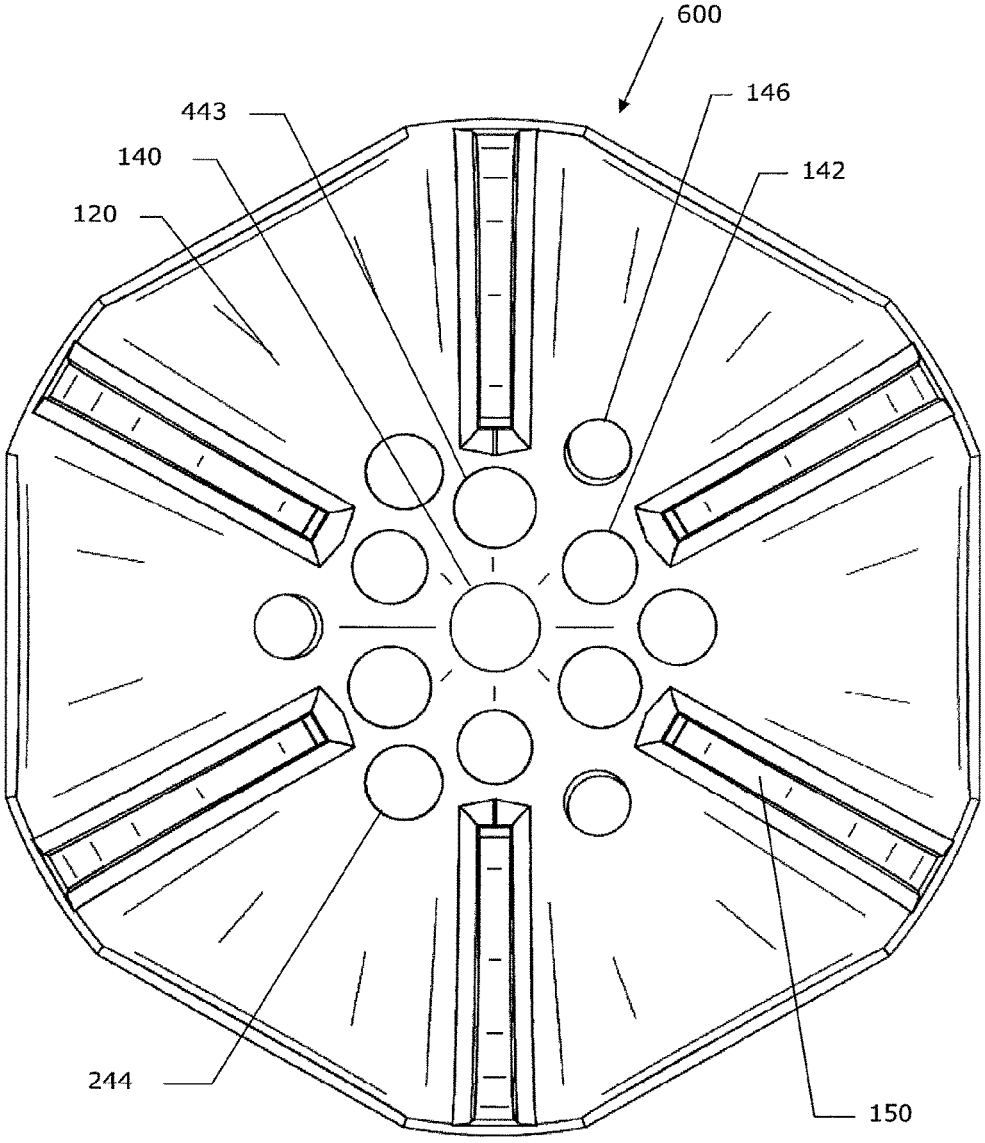
FIGS. 38-42 provide a top (FIG. 38), side (FIG. 39), cross-sectional (FIG. 40), rotated side (FIG. 41), and bottom (FIG. 42) view of the nozzle depicted in FIGS. 31-35.
Figure 39:
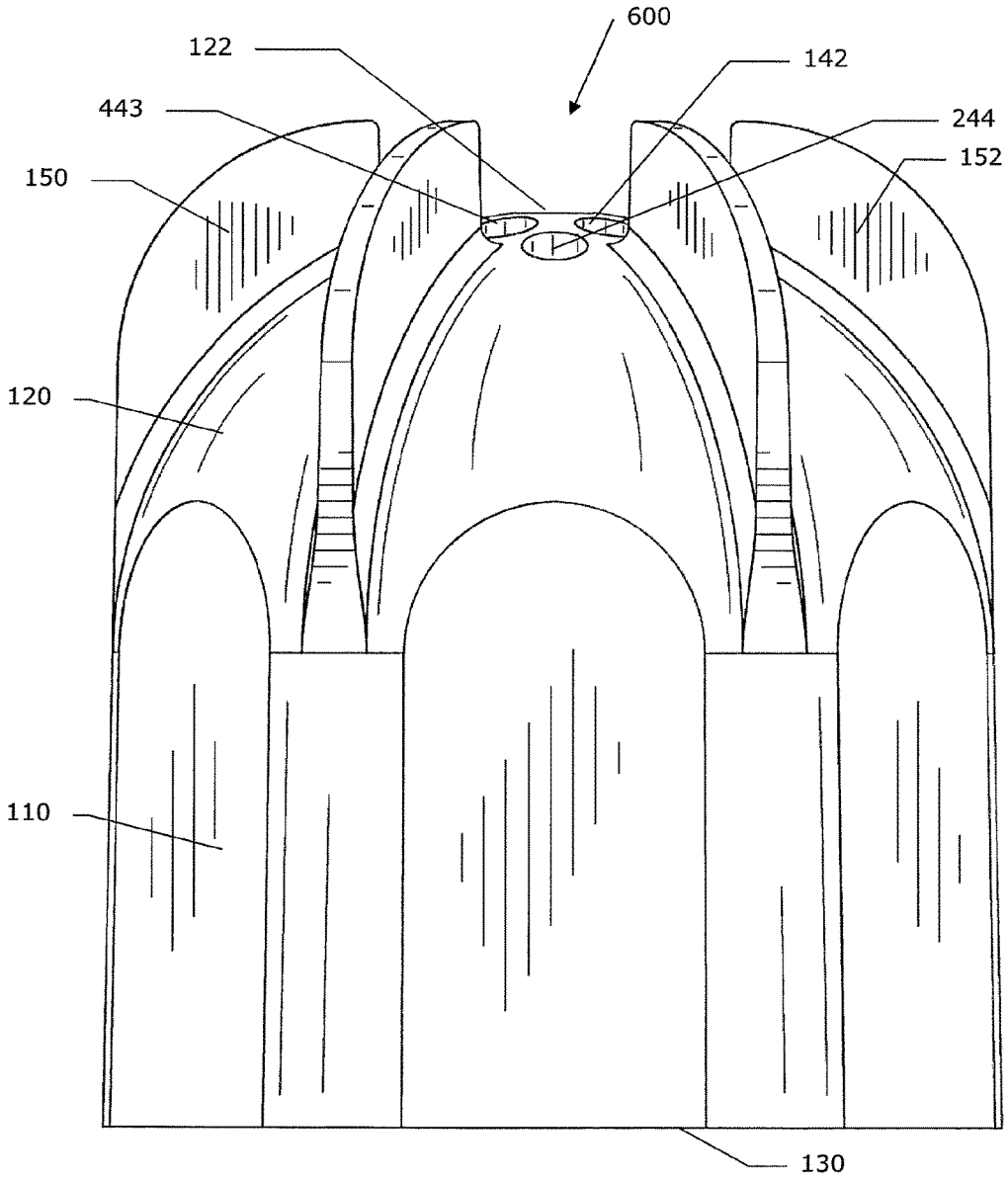
Figure 40:
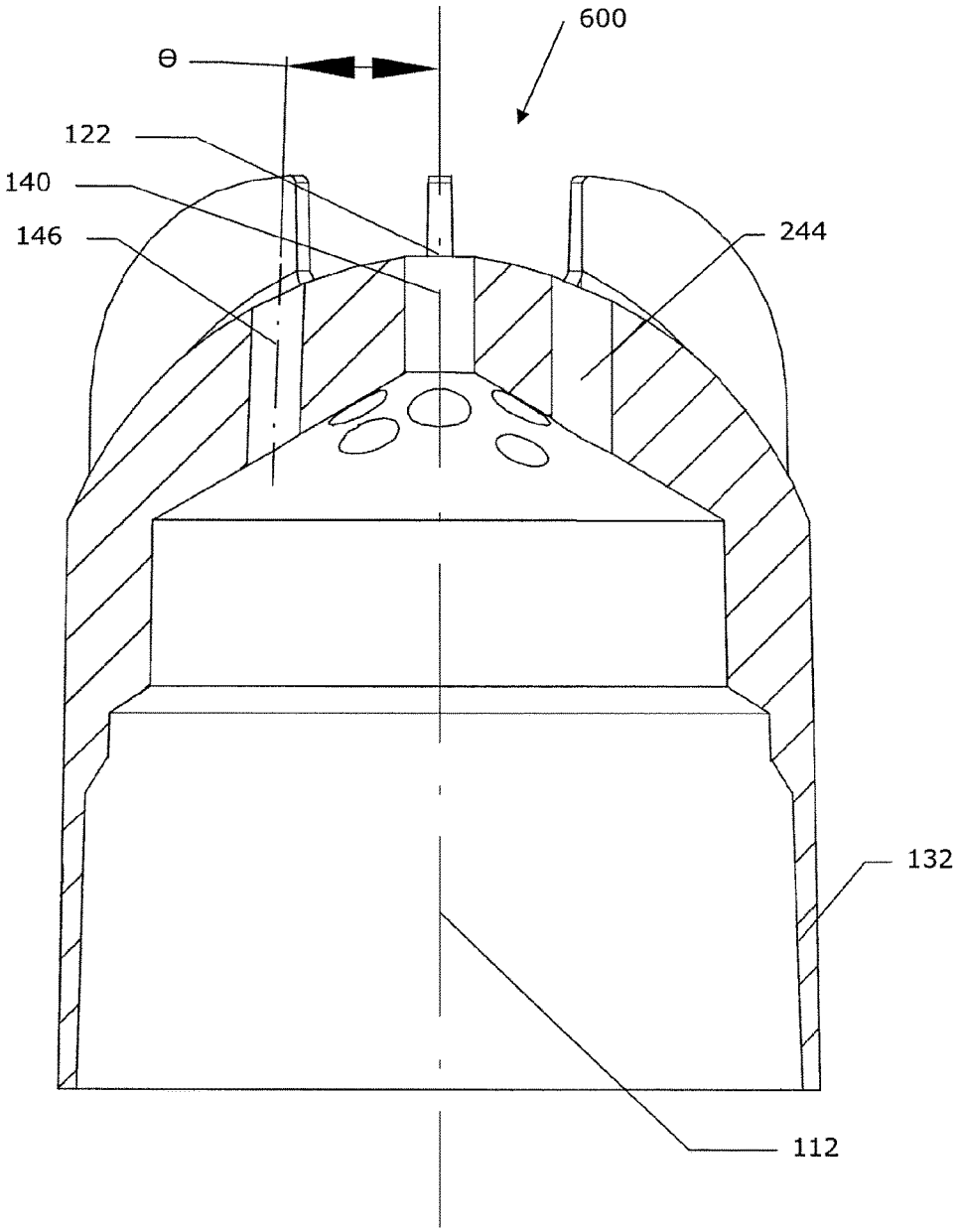
Figure 41:
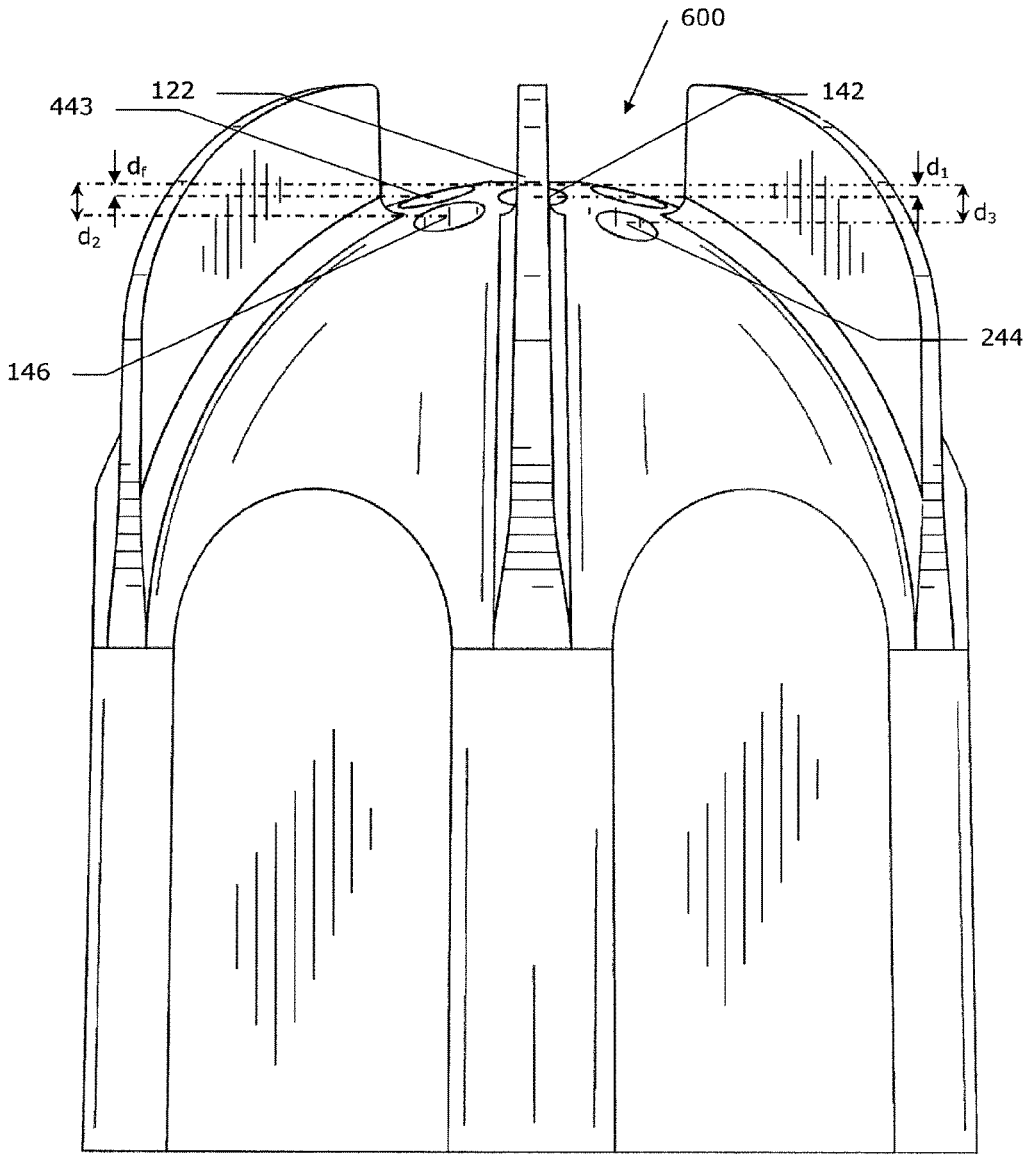
Figure 42:
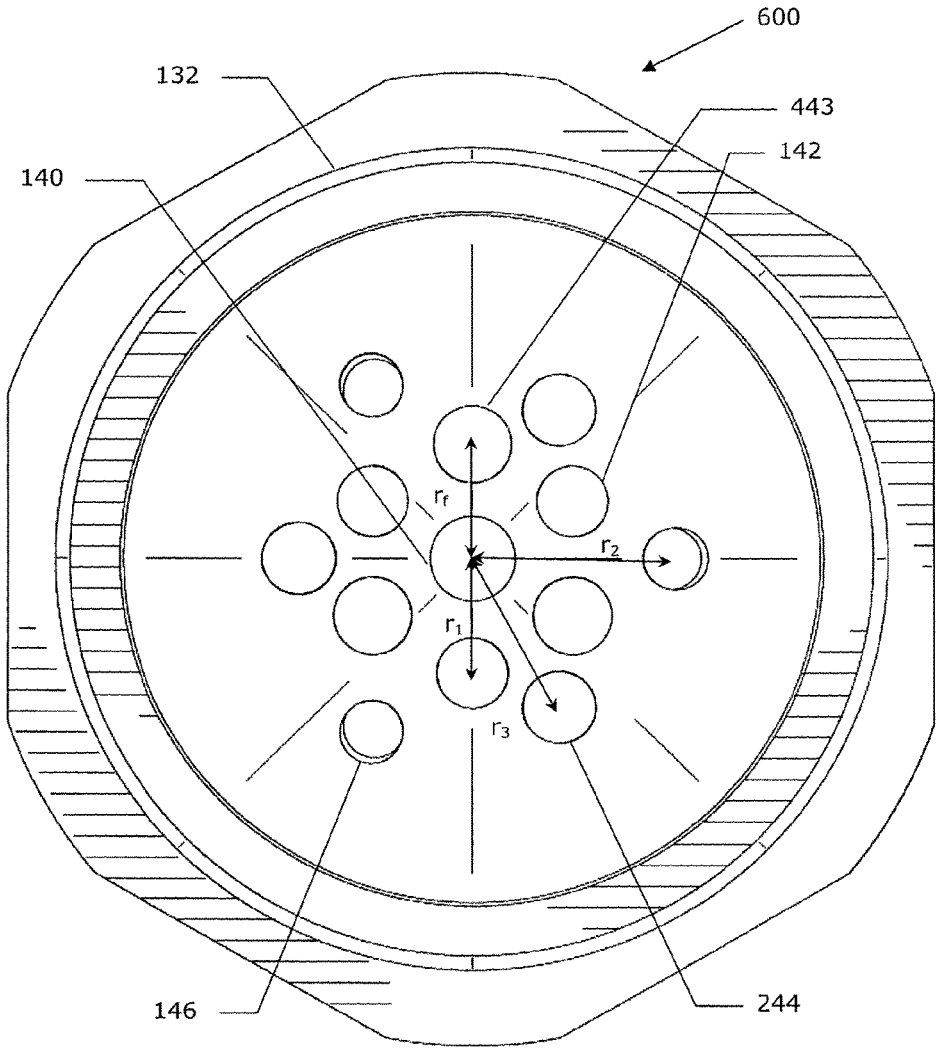

As can best be seen in FIGS. 24 and 28, a set of further outlets 443 is also provided in this embodiment. These further outlets 443 are disposed on a further radius ($r_f$), which in this embodiment is equal to the first radius ($r_1$). As a result, the further outlets 443 are also at a further distance ($d_f$) which is equal to the first distance ($d_1$). The further outlets 443 have a diameter which is greater than the first outlets 142 but still less than the central outlet 140.

In this embodiment, there are three further outlets 443, the diameter of which is approximately 8 percent larger than the first outlets 142 but approximately 14 percent smaller than the central outlet 140. In this embodiment, the total discharge area of the further outlets 443 is greater than the total discharge area of the first outlets 142. Here, the further outlets 443 are also positioned in a radially symmetric pattern along the first radius ($r_1$) and are located between the first outlets 142.

Without committing to a particular theory, the inventors believe that the further outlets 443 provide additional gas flow along the first radius ($r_1$), which may be necessary to accommodate larger nozzle 400 diameters. Although similar results may be obtained in some cases by simply increasing the number of first outlets 142 as appropriate, the use of further outlets 443 that are larger in diameter than the third outlets 244, is believed to increase the rate at which ambient gases are entrained into the gas flow.

In this embodiment, there are no third outlets; however, fourth outlets 248 are provided and are largely analogous to those described above for nozzle 200 depicted in FIGS. 8-14. In this embodiment, the fourth radius ($r_4$) is approximately 17 percent larger than the second radius ($r_2$). The diameter of the fourth outlets 248 is also larger than the second outlets 146, in this case by approximately 30 percent.

The first, further, and fourth outlets 142, 443, 248 are all sequentially offset relative to one another, in this case by ½, and exhibit substantial radial symmetry.

FIGS. 29-35 provide a nozzle 500 according to a fifth embodiment of the present invention. In this embodiment there are three first outlets 142, three further outlets 443, three third outlets 244, but the fourth outlets 248 are omitted.

In general terms, the nozzle 500 consists of an elongate nozzle body 110 having a blowing end 120 and a supply end 130. The blowing end 120 of the nozzle 500 is substantially parabolic. A series of outlets 140, 142, 443,244, 146 are provided (See FIG. 31) on the blowing end 120 for generating a flow of compressed gas along a blowing axis 112 (See FIG. 33). An inlet 132 is provided on the supply end 130 for supplying compressed gases to the nozzle 100. In this embodiment, the inlet 132 is a 1.25" NPT connector.

As with the other nozzles described above, the nozzle 500 in FIGS. 29-35 has a central outlet 140 at an apex 122, first outlets 142 disposed about the central outlets at a first distance ($d_1$) and first radius ($r_1$), and second outlets 146 positioned below the first outlets at a second distance ($d_2$) and a second radius ($r_2$). The second outlets 146 are angled inward toward the blowing axis 112 at an angle (θ) of 1.0 degree. Each of these features are analogous to those described for nozzle 100 above.

As with nozzle 400 above, this embodiment also has further outlets 443 disposed on a further radius ($r_f$) and further distance ($d_f$) equal to the first radius ($r_1$) and first distance ($d_1$). The further outlets 443 in nozzle 500 are analogous to those described in nozzle 400. In this embodiment, the further outlets 443 are approximately 12.5% larger than the first outlets 142. As with nozzle 400, the further outlets 443 are once again positioned between the first outlets 142, in a radially symmetric pattern.

Third outlets 244 are also provided, which are analogous to those described above for nozzle 200. In nozzle 500, the third radius ($r_3$) is approximately 50 percent larger than the first radius ($r_1$) and the second radius ($r_2$) is approximately 17 percent larger than the third radius ($r_3$). The diameter of the third outlets 244 is also larger than the first outlets 142, in this case by approximately 8 percent.

As with other embodiments, a set of fins 150 is also provided on the blowing end 120 of the nozzle 500. In this embodiment, the second and third outlets 146, 244 are positioned between the fins 150, which is believed to increase the rate at which ambient gases are entrained into the flow emitted by the nozzle 500.

FIGS. 36-41 provide a nozzle 600 according to a fifth embodiment of the present invention. The large diameter of this embodiment results in a blowing end 120 that is more rounded in shape, but still substantially parabolic. As with the other nozzles, second outlets 146 are also provided, but in this case the inward angle is 2.0 degrees.

In general terms, the nozzle 600 consists of an elongate nozzle body 110 having a blowing end 120 and a supply end 130. The blowing end 120 of the nozzle 600 is substantially parabolic. A series of outlets 140, 142, 443,244, 146 are provided (See FIG. 38) on the blowing end 120 for generating a flow of compressed gas along a blowing axis 112 (See FIG. 40). An inlet 132 is provided on the supply end 130 for supplying compressed gases to the nozzle 100. In this embodiment, the inlet 132 is a 1.5" NPT connector.

As with the other nozzles described above, the nozzle 600 in FIGS. 36-41 has a central outlet 140 at an apex 122, first outlets 142 disposed about the central outlets at a first distance ($d_1$) and first radius ($r_1$), and second outlets 146 positioned below the first outlets at a second distance ($d_2$) and a second radius ($r_2$). The second outlets 146 are angled inward toward the blowing axis 112 at an angle (θ) of 2.0 degrees. Each of these features are analogous to those described for nozzle 100 above.

As with nozzle 400 above, this embodiment also has further outlets 443 disposed on a further radius ($r_f$) and further distance ($d_f$) equal to the first radius ($r_1$) and first distance ($d_1$). The further outlets 443 in nozzle 600 are analogous to those described in nozzle 400. In this embodiment, the further outlets 443 are approximately 10% larger than the first outlets 142. As with nozzle 400, the further outlets 443 are also positioned between the first outlets 142 in a radially symmetric pattern.

Third outlets 244 are also provided, which are analogous to those described above for nozzle 500. In nozzle 600, the third radius ($r_3$) is approximately 50 percent larger than the first radius ($r_1$) and the second radius ($r_2$) is approximately 17 percent larger than the third radius ($r_3$). The diameter of the third outlets 244 is also larger than the first outlets 142, in this case by approximately 2.5 percent.

As with other embodiments, a set of fins 150 is also provided on the blowing end 120 of the nozzle 600. In this embodiment, the second and third outlets 142, 244 are positioned between the fins 150, which is believed to increase the rate at which ambient gases are entrained into the flow emitted by the nozzle 600.

In operation, a nozzle according to the present invention is connected at the inlet 132 to a supply of compressed gases, such as air. A variety of gas supply pressures may be used, although gas supply pressures of between 20-40 and 80-120 psi are preferred. Compressed gases are then emitted by the outlets to generate a flow of gas along the blowing axis 112. Various outlets may be provided as described above to entrain ambient gases into the flow of the nozzle. The positioning and angling of the outlets may also reduce turbulence within the flow emitted by the nozzle, which may increase the force emitted at a particular distance for a given supply pressure.

A variety of methods and materials can be used to construct a blowing nozzle according to the present invention. In some embodiments, the nozzle is CNC milled from a block of aluminum. In other embodiments, cast steel forms may be used to reduce costs, particularly if the outlets are drilled into the nozzle after casting. In still further other embodiments, the nozzle may be constructed from aluminum, steel, brass, stainless steel, plastic, zinc, or a magnesium-zinc alloy. Other suitable materials and methods of construction would be readily apparent to the person of skill in the art having regard the present disclosure.

The embodiments of the present disclosure are intended to be examples only. Those of skill in the art may effect alterations, modifications and variations to the particular embodiments without departing from the intended scope of the present application.

In particular, features from one or more of the above-described embodiments may be selected to create alternate embodiments comprised of a subcombination of features which may not be explicitly described above. In addition, features from one or more of the above-described embodiments may be selected and combined to create alternate embodiments comprised of a combination of features which may not be explicitly described above. Features suitable for such combinations and subcombinations would be readily apparent to persons skilled in the art upon review of the present application as a whole. The subject matter described herein and in the recited claims intends to cover and embrace all suitable changes in technology.

The invention claimed is:

1. A nozzle for blowing pressurized gas, the nozzle comprising:

an elongate nozzle body having a supply end for receiving a supply of compressed gas and a substantially parabolic blowing end for blowing compressed gas along a blowing axis, the blowing end converging at an apex coaxial with the blowing axis;

the blowing end comprising:

a central outlet for generating a core stream of gas at the apex;

at least three first outlets disposed at a first radius from the blowing axis, wherein:

the first outlets are substantially parallel to the blowing axis and surround the core stream of gas, and the diameter of the first outlets is less than the diameter of the central outlet;

at least three second outlets disposed at a second radius from the blowing axis, wherein:

the second outlets are angled inward toward the blowing axis, the diameter of the second outlets is less than the diameter of the first outlets, and the second radius is greater than the first radius.

2. The nozzle of claim 1, wherein the total discharge area of the first outlets is greater than the discharge area of the central outlet.

3. The nozzle of claim 1, wherein the total discharge area of the second outlets is less than the total discharge area of the first outlets.

4. The nozzle of claim 1, wherein the second outlets are offset relative to the first outlets.

5. The nozzle of claim 1, wherein the angle of the second outlets relative to the blowing axis is between 0.25 and 5 degrees.

6. The nozzle of claim 1, wherein the angle of the second outlets relative to the blowing axis is about 0.5 degrees, about 1 degree, about 1.5 degrees, or about 2 degrees.

7. The nozzle of claim 1, wherein each of the second outlets have an inner surface, the elongate nozzle body defines an interior chamber having a chamber wall, and the inner surface of the second outlets is tangential to the chamber wall.

8. The nozzle of claim 1, wherein the nozzle further comprises at least six fins substantially parallel to the blowing axis and extending outwardly from the elongate nozzle body and along the blowing end thereof, wherein each of the second outlets is positioned between a pair of the at least six fins.

9. The nozzle of claim 1, wherein the blowing end further comprises:

at least three third outlets disposed at a third radius from the blowing axis, wherein:

the third radius is greater than the first radius but less than the second radius, and the diameter of the third outlets is greater than the diameter of the first outlets.

10. The nozzle of claim 9, wherein the total discharge area of the third outlets is greater than the total discharge area of the first outlets.

11. The nozzle of claim 9, wherein the third outlets are offset relative to the first outlets.

12. The nozzle of claim 9, wherein the blowing end further comprises at least three further outlets disposed on the first radius and offset from the first outlets, wherein the diameter of the further outlets is greater than the diameter of the first outlets and the third outlets but less than the diameter of the central outlet.

13. The nozzle of claim 12, wherein the total discharge area of the further outlets is greater than the total discharge area of the first outlets.

14. The nozzle of claim 9, wherein the blowing end further comprises:

at least three fourth outlets disposed at a fourth radius from the blowing axis, wherein:

the fourth radius is greater than the second radius, and the diameter of the fourth outlets is greater than the diameter of the second outlets.

15. The nozzle of claim 14, wherein the total discharge area of the fourth outlets is greater than the total discharge area of the second outlets.

16. The nozzle of claim 14, wherein the fourth outlets are offset relative to the second outlets.

17. A method of generating a flow of compressed gases along a blowing axis from a nozzle having a substantially parabolic blowing end converging at an apex coaxial with the blowing axis, the method comprising:

supplying compressed gas to an inlet of the nozzle;

emitting a core stream of gas from a central outlet at the apex of the blowing end of the nozzle;

emitting a first concentric stream of gas from the blowing end which surrounds the core stream, the first stream having a higher pressure than the core stream; and emitting a second concentric stream of gas from the blowing end which surrounds the first stream, the second stream angled inward toward the blowing axis and having a higher pressure than the first stream.

18. The method of claim 17, further comprising emitting a third concentric stream of gas which surrounds the first stream and is surrounded by the second stream, the third stream having a lower pressure than the first stream and the second stream.

19. The method of claim 17, further comprising emitting an additional stream of gas which surrounds the second stream, the additional stream having a lower pressure than the second stream.

20. The method of claim 17, wherein the nozzle further comprises at least six fins substantially parallel to the blowing axis and extending outwardly from the blowing end proximate to the second stream.

* * * * *